US009894991B2

(12) United States Patent
Volin

(10) Patent No.: US 9,894,991 B2
(45) Date of Patent: Feb. 20, 2018

(54) UNIQUE PORTABLE FOLDABLE FIVE-DEVICE-IN-ONE KNEELER-BENCH-CADDY-TABLE-UMBRELLA SYSTEM, HAVING KNEELER SYSTEM, BENCH SYSTEM, CADDY SYSTEM, TABLE SYSTEM, AND KNEELER-BENCH-CADDY-TABLE-LOCKING UMBRELLA SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 270 days.

(21) Appl. No.: 14/971,869

(22) Filed: Dec. 16, 2015

(65) Prior Publication Data

US 2016/0174706 A1 Jun. 23, 2016

Related U.S. Application Data

(60) Provisional application No. 62/094,942, filed on Dec. 19, 2014.

(51) Int. Cl.

| | |
|---|---|
| ***A47B 85/06*** | (2006.01) |
| ***A47B 85/04*** | (2006.01) |
| ***A47B 37/04*** | (2006.01) |
| ***A47C 1/14*** | (2006.01) |
| ***A47C 11/00*** | (2006.01) |

(Continued)

(52) U.S. Cl.

CPC ..... *A47B 85/04* (2013.01); *A45B 9/00* (2013.01); *A45B 23/00* (2013.01); *A47B 13/16* (2013.01); *A47B 37/04* (2013.01); *A47C 1/14* (2013.01); *A47C 7/66* (2013.01); *A47C 11/00* (2013.01); *A45B 2009/002* (2013.01); *A45B 2023/0012* (2013.01); *A45B 2200/1063* (2013.01); *A47B 3/10* (2013.01); *A47B 2220/0008* (2013.01)

(58) Field of Classification Search

CPC ..... A45B 2023/0012; A45B 2200/1063

See application file for complete search history.

(56) References Cited

U.S. PATENT DOCUMENTS

| | | | |
|---|---|---|---|
| 2,448,427 | A | 8/1948 | Gordon |
| 2,480,406 | A | 8/1949 | Forney |

(Continued)

*Primary Examiner* — Sarah B McPartlin

(57) ABSTRACT

A unique portable and foldable five-device-in-one system comprises: two foldable garden tables each for holding foods and drinks thereon, two foldable elastic garden-tool caddies each attached to the one of the two foldable garden tables and each for storing garden tools therein, two spring-loaded finger-centralizing stabilizers each welded to one of the two foldable garden tables and each for releasably locking the rotatable kneeler-bench cushion, a rotatable kneeler-bench cushion for providing comfort when seated or kneeled on, and an adjustable umbrella rotatably attached to one of the two foldable garden tables and having a kneeler-bench-caddy-table-locking arm for releasably locking the two foldable garden tables right side up. The unique portable and foldable five-device-in-one system can be used as an adjustable umbrella when providing shading protection, as two foldable garden-tool caddies when the two foldable caddies store garden tools, as a rotatable garden kneeler when the rotatable kneeler-bench cushion is upside down, as a rotatable garden bench when the rotatable kneeler-bench cushion is right side up, and as two foldable garden tables when the two foldable garden tables are locked right side up.

20 Claims, 16 Drawing Sheets

(51) Int. Cl.

| | |
|---|---|
| ***A47C 7/66*** | (2006.01) |
| ***A47B 13/16*** | (2006.01) |
| ***A45B 23/00*** | (2006.01) |
| ***A45B 9/00*** | (2006.01) |
| *A47B 3/10* | (2006.01) |

(56) References Cited

U.S. PATENT DOCUMENTS

| | | | |
|---|---|---|---|
| 2,484,494 | A | 10/1949 | Ferguson |
| 3,025,526 | A | 3/1962 | Ramon |
| 3,037,570 | A | 6/1962 | Olson |
| 3,541,313 | A | 11/1970 | Buzzi |
| 3,669,493 | A | 6/1972 | Vowles |
| 3,863,978 | A | 2/1975 | Gillings, Jr. |
| 3,902,758 | A | 9/1975 | Pivacek |
| 3,908,198 | A | 9/1975 | Brock |
| 3,976,155 | A | 8/1976 | Esch |
| 4,028,761 | A | 6/1977 | Taylor |
| 4,312,371 | A | 1/1982 | Koon |
| 4,377,309 | A | 3/1983 | Mengshoel |
| D271,727 | S | 12/1983 | Opsvik |
| 4,564,237 | A | 1/1986 | Steifensand |
| 4,662,675 | A | 5/1987 | Volpi |
| D291,264 | S | 8/1987 | Mengshoel |
| D292,452 | S | 10/1987 | Rykken |
| 4,732,285 | A | 3/1988 | Wuster |
| 4,942,693 | A | 7/1990 | Sibold |
| 4,920,897 | A | 10/1990 | Reed |
| D319,928 | S | 9/1991 | Weimholt |
| 5,197,394 | A | 3/1993 | Schmidt |
| D353,280 | S | 12/1994 | Westerburgen |
| D361,676 | S | 8/1995 | Westerburgen |
| 5,502,848 | A | 4/1996 | Cowan |
| 6,199,818 | B1 | 8/2001 | Tsappi |
| 6,330,886 | B1 | 12/2001 | Culver |
| 6,487,977 | B1 | 12/2002 | Williams |
| 7,240,683 | B2 | 7/2007 | Zutich |
| 7,316,239 | B2 | 1/2008 | Yang |
| 7,493,908 | B2 | 2/2009 | Carter |
| 8,231,172 | B2 | 7/2012 | Quinn |
| 8,469,044 | B1 | 6/2013 | Patel |
| D706,026 | S | 6/2014 | Akin |
| 8,800,577 | B2 | 8/2014 | Ma |
| 8,851,095 | B2 | 10/2014 | LeAnna |
| 2002/0157693 | A1 | 10/2002 | Whitmer |
| 2008/0230102 | A1 | 9/2008 | Blumenthal |

UNIQUE PORTABLE FOLDABLE FIVE-DEVICE-IN-ONE KNEELER-BENCH-CADDY-TABLE-UMBRELLA SYSTEM, HAVING KNEELER SYSTEM, BENCH SYSTEM, CADDY SYSTEM, TABLE SYSTEM, AND KNEELER-BENCH-CADDY-TABLE-LOCKING UMBRELLA SYSTEM

REFERENCE TO PREVIOUSLY FILED PROVISIONAL PATENT APPLICATION

Provisional Patent Application No. 62/094,942 was filed on Dec. 19, 2014.

1. FIELD OF THE INVENTION

The present invention relates to a unique portable and foldable five-device-in-one system, having:

1) A kneeler system,
2) A bench system,
3) Multi-caddy system,
4) Multi-table system, and
5) A kneeler-bench-caddy-table-locking umbrella system.

Particularly, the present invention relates to a unique portable and foldable five-device-in-one system, which:

1) Can be converted to a garden table
   for holding foods and refreshment for people to eat and drink,
2) Can be converted to a garden kneeler
   for people to kneel on and work,
3) Can be converted to a garden bench
   for people to sit on to rest, eat, and drink,
4) Can be converted to a table-supporting cushion
   for people to lean against to rest, eat, and drink,
5) Can provide garden caddies
   for conveniently carrying, storing, and providing garden tools and implements where people work,
6) Can provide wide handles
   for secure grips to pull oneself up from kneeling,
7) Can provide wide feet
   for stabilizing the portable and foldable five-device-in-one system on the ground,
8) Can prevent said four opposite curved-bar ends
   from getting jammed,
9) Can prevent said fingers
   from getting pinched, and
10) Can be disassembled
   for easy and convenient transport and storage.

2. DESCRIPTION OF THE PRIOR ART

A number of kneelers and benches or chairs have been introduced.

U.S. Pat. No. 2,448,427, issued 1948 Aug. 31, to B. Gordon;
U.S. Pat. No. 2,480,406, issued 1949 Aug. 30, to J. C. Forney;
U.S. Pat. No. 2,484,494, issued 1949 Oct. 11, to R. O. Ferguson;
U.S. Pat. No. 3,025,526, issued 1962 Mar. 20, to G. Ramon;
U.S. Pat. No. 3,037,570, issued 1962 Jun. 5, to J. R. H. Olson;
U.S. Pat. No. 3,541,313, issued 1970 Nov. 17, to A. Buzzi;
U.S. Pat. No. 3,669,493, issued 1972 Jun. 13, to J. Harding Vowles;
U.S. Pat. No. 3,863,978, issued 1975 Feb. 4, to Peter R. Gillings, Jr.;

U.S. Pat. No. 3,902,758, issued 1975 Sep. 2, to William J. Pivacek;
U.S. Pat. No. 3,908,198, issued 1975 Sep. 30, to W. L. Brock;
U.S. Pat. No. 3,976,155, issued 1976 Aug. 24, to Esch; Abner S.;
U.S. Pat. No. 4,028,761, issued 1977 Jun. 14, to John Taylor;
U.S. Pat. No. 4,312,371, issued 1982 Jan. 26, to Tan C. Koon;
U.S. Pat. No. 4,377,309, issued 1983 Mar. 22, to Hans C. Mengshoel;
U.S. Pat. No. 4,564,237, issued 1986 Jan. 14, to Friedrich M. Steifensand;
U.S. Pat. No. 4,662,675, issued 1987 May 5, to Giuseppe Volpi;
U.S. Pat. No. 4,732,285, issued 1988 Mar. 22, to Heinrich Wuster;
U.S. Pat. No. 4,920,897, issued 1990 Oct. 11, to Ross Reed;
U.S. Pat. No. 4,942,693, issued 1990 Jul. 24, to Josie Sibold;
U.S. Pat. No. 5,197,394, issued 1993 Mar. 30, to Brigitta C. Schmidt;
U.S. Pat. No. 5,502,848, issued 1996 Apr. 2, to James P. Cowan;
U.S. Pat. No. 6,199,818, issued 2001 Aug. 30, to Philip Tsappi;
U.S. Pat. No. 6,330,886, issued 2001 Dec. 18, to Philip H. Culver;
U.S. Pat. No. 6,487,977, issued 2002 Dec. 3, to Steven Williams;
U.S. Pat. No. 7,240,683, issued 2007 Jul. 10, to Stoyan Zutich;
U.S. Pat. No. 7,316,239, issued 2008 Jan. 8, to Lien-Chuan Yang;
U.S. Pat. No. 7,493,908, issued 2009 Feb. 24, to Philip R. Carter;
U.S. Pat. No. 8,231,172, issued 2012 Jul. 31, to Thomas A. Quinn;
U.S. Pat. No. 8,469,044, issued 2013 Jun. 25, to Vinod Patel;
U.S. Pat. No. 8,800,577, issued 2014 Aug. 12, to Joen-Shen Ma;
U.S. Pat. No. 8,851,095, issued 2014 Oct. 7, to David LeAnna;
U.S. Pat. No. D271,727, issued 1983 Dec. 13, to Peter Opsvik;
U.S. Pat. No. D291,264, issued 1987 Aug. 11, to Hans C. Mengshoel;
U.S. Pat. No. D292,452, issued 1987 Oct. 27, to Oddvin Rykken;
U.S. Pat. No. D319,928, issued 1991 Sep. 17, to Mark Weimholt;
U.S. Pat. No. D353,280, issued 1994 Dec. 13, to Josephus P. M. Westerburgen;
U.S. Pat. No. D361,676, issued 1995 Aug. 29, to Josephus P. M. Westerburgen;
U.S. Pat. No. D706,026, issued 2014 Jun. 3, to Sara Akin;
U.S. Pub. No. 20020157693, published 2002 Oct. 31, to Darrell Whitmer; and
U.S. Pub. No. 20080230102, published 2008 Sep. 25, to Emily Blumenthal.

disclose a variety of inventions related to kneelers and benches or chairs.

DISADVANTAGES OF THE PRIOR ART

The prior art have failed to solve many problems associated with such kneelers and benches or chairs, as follows:

1) No prior art mention or disclose any kneelers and benches or chairs,
having the following five-device-in-one portable and foldable devices:
1) A portable and foldable kneeler to kneel on,
2) A portable and foldable bench to sit and rest on,
3) Multiple portable and foldable caddies to store garden tools in,
4) Multiple portable and foldable tables to hold foods and refreshment, and
5) A portable and foldable umbrella.
Therefore, the prior art of kneelers and benches or chairs:
a) Can not be combined into one
to provide protection from the sun and rain to people while they are utilizing the kneeler, caddie, bench, or table;
b) Can not be combined into one
to meet a wide variety of customer needs from gardening, to sitting in the shade, to storing tools, to keeping tools handy, to providing tables for foods and refreshments, without the need for purchasing additional devices;
c) Can not be combined into one lightweight, portable, and foldable package to provide the extra convenience of having all parts and pieces connected into one user-friendly system;
d) Can not be combined into one lightweight, portable, and foldable package to easily lift, carry, store, and throw in the car for use at any outing;
e) Waste materials;
f) Increase unnecessary production costs;
g) Require additional labor, time, and money; and
h) Burden customers with unnecessary additional expenses by increasing the retail prices of the prior art.

2) No prior art mention or disclose any kneelers and benches or chairs,
having two quadruple-function foot-handle-caddy-table systems.
Therefore, the prior art of kneelers and benches or chairs:
a) Can not hold foods for people to eat;
b) Can not hold refreshment for people to drink;
c) Are inconvenient and not user-friendly;
d) Are cumbersome to be operated; and
e) Are unreliable.

3) No prior art mention or disclose any kneelers and benches or chairs,
having four dual-function foot-handles.
Therefore, the prior art of kneelers and benches or chairs:
a) Can not provide wide foot prints for stable contacts with the ground to stabilize the unique portable and foldable five-device-in-one kneeler-bench-caddy-table-umbrella system;
b) Can not provide wide handles for secure grips to easily hold onto to pull oneself up from kneeling;
c) Are inconvenient and not user-friendly;
d) Are cumbersome to be operated; and
e) Are unreliable.

4) No prior art mention or disclose any kneelers and benches or chairs,
having four piston-stabilizing cylinders.
Therefore, the prior art of kneelers and benches or chairs:
a) Can not stabilize the oscillations of the four pistons of the unique portable and foldable five-device-in-one kneeler-bench-caddy-table-umbrella system in straight lines to prevent the four pistons from bending and getting jammed;
b) Can not align the oscillations of the four pistons of the unique portable and foldable five-device-in-one kneeler-bench-caddy-table-umbrella system in straight lines
to prevent the four pistons from bending and getting jammed;
c) Can not stabilize the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
d) Can not align the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
e) Are cumbersome to be operated;
f) Are unreliable; and
g) Have a shortened service lifespan.

5) No prior art mention or disclose any kneelers and benches or chairs,
having two finger-centralizing curved bars.
Therefore, the prior art of kneelers and benches or chairs:
a) Can not centralize a person's fingers on the two finger-centralizing curved bars and away from the opposite ends of the two finger-centralizing curved bars
to prevent the fingers from accidentally being pinched by the opposite ends of the two finger-centralizing curved bars;
b) Cause accidents to people;
c) Cause pain and personal injury; and
d) Burden people with medical expenses.

6) No prior art mention or disclose any kneelers and benches or chairs,
having four finger-protecting shields.
Therefore, the prior art of kneelers and benches or chairs:
a) Can not shield a person's fingers from the opposite ends of the two finger-centralizing curved bars
to prevent the fingers from accidentally getting pinched by the opposite ends of the two finger-centralizing curved bars;
b) Cause accidents to people;
c) Cause pain and personal injury; and
d) Burden people with medical expenses.

7) No prior art mention or disclose any kneelers and benches or chairs,
having four teardrop-like U-frame openings.
Therefore, the prior art of kneelers and benches or chairs:
a) Can not centralize the opposite ends of the two finger-centralizing curved bars while they are oscillating between a locked and unlocked position to prevent the opposite ends of the two finger-centralizing curved bars from bending and getting jammed in the four teardrop-like U-frame openings;
b) Are cumbersome to be operated;
c) Are unreliable; and
d) Have a shortened service lifespan.

8) No prior art mention or disclose any kneelers and benches or chairs,
having two multi-purpose tables and multiple built-in cup holders.

Therefore, the prior art of kneelers and benches or chairs:

a) Can not serve as multiple outdoor shaded multi-purpose tables with multiple built-in cup holders
to hold foods and refreshments for people to eat and drink in the shade while they are working, resting, or playing outdoors;

b) Can not serve as multiple outdoor shaded cup holders to secure drinking glasses, drinking cups, or beverage cans therein against wind;

c) Cause inconvenience; and d) Provide no means to hold foods and refreshments securely.

9) No prior art mention or disclose any kneelers and benches or chairs,
having two elastic garden-tool multi-pocket caddies.

Therefore, the prior art of kneelers and benches or chairs:

a) Can not tightly and separately carry multiple garden tools in separate pockets
to keep tools organized, and to have them within convenient reach when kneeling on the portable and foldable kneeler of the unique portable and foldable five-device-in-one kneeler-bench-caddy-table-umbrella system to weed, plant, or do other yard work;

b) Can not tightly and separately store multiple garden tools in separate pockets to keep tools organized, and to have them within convenient reach when kneeling on the portable and foldable kneeler of the unique portable and foldable five-device-in-one kneeler-bench-caddy-table-umbrella system to weed, plant, or do other yard work;

c) Force people to leave the tools disorganized on the ground; and d) Cause accidents of people tripping on and falling on the tools scattered on the ground.

10) No prior art mention or disclose any kneelers and benches or chairs,
having five-device-in-one compact and foldable devices of a garden kneeler, a garden bench, garden caddies, garden tables, and a garden umbrella combined into one.

Therefore, the prior art of kneelers and benches or chairs:

a) Can not be easily assembled and disassembled
to provide easy set-up and take-down, without the need for tools;

b) Can not be easily folded down into a compact size and packed into a carrying bag
to allow easy transport and to make it easy to reach a desired location without forgetting any parts;

c) Can not easily be transformed from a kneeler, to a bench, and to a table all with sunshade umbrella attached
to meet people's needs for sitting, resting, eating, drinking, and gardening, at any time;

d) Require a lot of storage space;

e) Are cumbersome to transport and store;

f) Are impossible to be combined all into one device; and g) Are impossible to be stored all in a carrying bag.

11) No prior art mention or disclose any kneelers and benches or chairs,
having kneeler-bench-caddy-table-locking arm and arm-locking button.

Therefore, the prior art of kneelers and benches or chairs:

a) Can not lock two multi-purpose tables and multiple built-in cup holders in an upright position
to easily and conveniently hold foods and refreshments;

b) Can not lock two tool-organizing caddies
in a horizontal position
to easily and conveniently store and keep garden tools organized;

c) Can not lock a kneeler-bench cushion
in a vertical position
to provide a cushion for people to lean against while resting, eating, and drinking;

d) Are inconvenient and not user-friendly;

e) Are cumbersome to be operated; and f) Are unreliable.

12) No prior art mention or disclose any kneelers and benches or chairs,
having kneeler-bench-caddy-table-mounting clamp.

Therefore, the prior art of kneelers and benches or chairs:

a) Can not rotatably attach a foldable kneeler, a foldable bench, two foldable caddies, and two foldable tables to an adjustable foldable umbrella to easily and conveniently combine five devices into one;

b) Can not rotatably allow the unique portable and foldable five-device-in-one kneeler-bench-caddy-table-umbrella system
to easily and conveniently convert into a garden kneeler, two tool-organizing caddies, and an adjustable umbrella;

c) Can not rotatably allow the unique portable and foldable five-device-in-one kneeler-bench-caddy-table-umbrella system
to easily and conveniently convert into a garden bench, two tool-organizing caddies, and an adjustable umbrella;

d) Can not rotatably allow the unique portable and foldable five-device-in-one kneeler-bench-caddy-table-umbrella system
to easily and conveniently convert into two multi-purpose tables, two tool-organizing caddies, and an adjustable umbrella;

e) Can not rotatably allow the unique portable and foldable five-device-in-one kneeler-bench-caddy-table-umbrella system
to easily and conveniently convert into two tool-organizing caddies, an adjustable umbrella, and a garden kneeler, a garden bench, or two multi-purpose tables;

f) Are inconvenient and not user-friendly;

g) Are cumbersome to be operated;

h) Are unreliable;

i) Waste materials;

j) Increase unnecessary production costs;

k) Require additional labor, time, and money; and l) Burden customers with unnecessary additional expenses by increasing the retail prices of the prior art.

OBJECTS AND ADVANTAGES OF THE INVENTION

The present invention substantially departs from the conventional concepts and designs of the prior art. In doing so, the present invention provides a
unique portable and foldable five-device-in-one system of a garden kneeler, a garden bench, multiple garden caddies, multiple garden tables, and a garden umbrella,
having many unique and significant features, functions, and advantages, which overcome all the disadvantages of the prior art, as follows:

1) It is an object of the present invention to provide a unique portable and foldable five-device-in-one kneeler-bench-caddy-table-umbrella system,
having the following five-device-in-one portable and foldable devices:

1) A portable and foldable kneeler to kneel on,
2) A portable and foldable bench to sit and rest on,
3) Multiple portable and foldable caddies to store garden tools in,
4) Multiple portable and foldable tables to hold foods and refreshment, and
5) A portable and foldable umbrella.

The above-mentioned five-device-in-one portable and foldable devices:

a) Can be combined into one
to provide protection from the sun and rain to people while they are utilizing the kneeler, caddie, bench, or table;
b) Can be combined into one
to meet a wide variety of customer needs from gardening, to sitting in the shade, to storing tools, to keeping tools handy, to providing tables for foods and refreshments, without the need for purchasing additional devices;
c) Can be combined into one lightweight, portable, and foldable package to provide the extra convenience of having all parts and pieces connected into one user-friendly system;
d) Can be combined into one lightweight, portable, and foldable package to easily lift, carry, store, and throw in the car for use at any outing;
e) Save materials;
f) Save production costs;
g) Save labor, time, and money; and
h) Promote happy customers by passing savings down to consumers.

2) It is another object of the present invention to provide a unique portable and foldable five-device-in-one kneeler-bench-caddy-table-umbrella system,
having two quadruple-function foot-handle-caddy-table systems.

Therefore, the unique portable and foldable five-device-in-one kneeler-bench-caddy-table-umbrella system:

a) Can hold foods for people
to eat;
b) Can hold refreshment for people
to drink;
c) Are convenient and user-friendly;
d) Are easily operated; and
e) Are reliable.

3) It is a further object of the present invention to provide a unique portable and foldable five-device-in-one kneeler-bench-caddy-table-umbrella system,
having four dual-function foot-handles.

Therefore, the unique portable and foldable five-device-in-one kneeler-bench-caddy-table-umbrella system:

a) Can provide wide foot prints for stable contacts with the ground to stabilize the unique portable and foldable five-device-in-one kneeler-bench-caddy-table-umbrella system;
b) Can provide wide handles for secure grips to easily hold onto
to pull oneself up from kneeling;
c) Are convenient and user-friendly;
d) Are easily operated; and
e) Are reliable.

4) It is an even further object of the present invention to provide a unique portable and foldable five-device-in-one kneeler-bench-caddy-table-umbrella system,
having four piston-stabilizing cylinders.

Therefore, the unique portable and foldable five-device-in-one kneeler-bench-caddy-table-umbrella system:

a) Can stabilize the oscillations of the four pistons of the unique portable and foldable five-device-in-one kneeler-bench-caddy-table-umbrella system in straight lines
to prevent the four pistons from bending and getting jammed;
b) Can align the oscillations of the four pistons of the unique portable and foldable five-device-in-one kneeler-bench-caddy-table-umbrella system in straight lines
to prevent the four pistons from bending and getting jammed;
c) Can stabilize the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
d) Can align the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
e) Are easily operated;
f) Are reliable; and
g) Have a prolonged service lifespan.

5) It is another object of the present invention to provide a unique portable and foldable five-device-in-one kneeler-bench-caddy-table-umbrella system,
having two finger-centralizing curved bars.

Therefore, the unique portable and foldable five-device-in-one kneeler-bench-caddy-table-umbrella system:

a) Can centralize a person's fingers on the two finger-centralizing curved bars and away from the opposite ends of the two finger-centralizing curved bars to prevent the fingers from accidentally being pinched by the opposite ends of the two finger-centralizing curved bars;
b) Prevent accidents from happening;
c) Prevent pain and personal injury; and
d) Prevent medical expenses.

6) It is still another object of the present invention to provide a unique portable and foldable five-device-in-one kneeler-bench-caddy-table-umbrella system,
having four finger-protecting shields.

Therefore, the unique portable and foldable five-device-in-one kneeler-bench-caddy-table-umbrella system:

a) Can shield a person's fingers from the opposite ends of the two finger-centralizing curved bars
to prevent the fingers from accidentally getting pinched by the opposite ends of the two finger-centralizing curved bars;
b) Prevent accidents from happening;
c) Prevent pain and personal injury; and
d) Prevent medical expenses.

7) It is a further object of the present invention to provide a unique portable and foldable five-device-in-one kneeler-bench-caddy-table-umbrella system,
having four teardrop-like U-frame openings.

Therefore, the unique portable and foldable five-device-in-one kneeler-bench-caddy-table-umbrella system:

a) Can centralize the opposite ends of the two finger-centralizing curved bars while they are oscillating between a locked and unlocked position to prevent the opposite ends of the two finger-centralizing curved bars from bending and getting jammed in the four teardrop-like U-frame openings;

b) Are easily operated;

c) Are reliable; and d) Have a prolonged service lifespan.

8) It is an even further object of the present invention to provide a unique portable and foldable five-device-in-one kneeler-bench-caddy-table-umbrella system, having two multi-purpose tables and multiple built-in cup holders.

Therefore, the unique portable and foldable five-device-in-one kneeler-bench-caddy-table-umbrella system:

a) Can serve as multiple outdoor shaded multi-purpose tables with multiple built-in cup holders
to hold foods and refreshments for people to eat and drink in the shade while they are working, resting, or playing outdoors;

b) Can serve as multiple outdoor shaded cup holders
to secure drinking glasses, drinking cups, or beverage cans therein against wind;

c) Provide convenience; and d) Provide multiple means to hold foods and refreshments securely.

9) It is yet a further object of the present invention to provide a unique portable and foldable five-device-in-one kneeler-bench-caddy-table-umbrella system, having two elastic garden-tool multi-pocket caddies.

Therefore, the unique portable and foldable five-device-in-one kneeler-bench-caddy-table-umbrella system:

a) Can tightly and separately carry multiple garden tools in separate pockets to keep tools organized, and to have them within convenient reach when kneeling on the portable and foldable kneeler of the unique portable and foldable five-device-in-one kneeler-bench-caddy-table-umbrella system to weed, plant, or do other yard work;

b) Can tightly and separately store multiple garden tools in separate pockets to keep tools organized, and to have them within convenient reach when kneeling on the portable and foldable kneeler of the unique portable and foldable five-device-in-one kneeler-bench-caddy-table-umbrella system to weed, plant, or do other yard work;

c) Help with keeping track of tools; and d) Help eliminate tripping hazards when tools are scattered on the ground.

10) It is yet an even further object of the present invention to provide a unique portable and foldable five-device-in-one kneeler-bench-caddy-table-umbrella system, having five-device-in-one compact and foldable devices of a garden kneeler, a garden bench, garden caddies, garden tables, and a garden umbrella combined into one.

Therefore, the unique portable and foldable five-device-in-one kneeler-bench-caddy-table-umbrella system:

a) Can be easily assembled and disassembled to provide easy set-up and take-down, without the need for tools;

b) Can be easily folded down into a compact size and packed into a carrying bag
to allow easy transport and to make it easy to reach a desired location without forgetting any parts;

c) Can easily be transformed from a kneeler, to a bench, and to a table all with sunshade umbrella attached
to meet people's needs for sitting, resting, eating, drinking, and gardening, at any time;

d) Are compact when folded, and saves space;

e) Are portable; and f) Are easily stored in a carrying bag.

11) It is still yet an even further object of the present invention to provide a unique portable and foldable five-device-in-one kneeler-bench-caddy-table-umbrella system, having kneeler-bench-caddy-table-locking arm and arm-locking button.

Therefore, the unique portable and foldable five-device-in-one kneeler-bench-caddy-table-umbrella system:

a) Can lock two multi-purpose tables and multiple built-in cup holders in an upright position
to easily and conveniently hold foods and refreshments;

b) Can lock two tool-organizing caddies
in a horizontal position
to easily and conveniently store and keep garden tools organized;

c) Can lock a kneeler-bench cushion
in a vertical position
to provide a cushion for people to lean against while resting, eating, and drinking;

d) Are convenient and user-friendly;

e) Are easily operated; and f) Are reliable.

12) It is still yet an even further object of the present invention to provide a unique portable and foldable five-device-in-one kneeler-bench-caddy-table-umbrella system, having kneeler-bench-caddy-table-mounting clamp.

Therefore, the unique portable and foldable five-device-in-one kneeler-bench-caddy-table-umbrella system:

a) Can rotatably attach a foldable kneeler, a foldable bench, two foldable caddies, and two foldable tables to an adjustable foldable umbrella to easily and conveniently combine five devices into one;

b) Can rotatably allow the unique portable and foldable five-device-in-one kneeler-bench-caddy-table-umbrella system
to easily and conveniently convert into a garden kneeler, two tool-organizing caddies, and an adjustable umbrella;

c) Can rotatably allow the unique portable and foldable five-device-in-one kneeler-bench-caddy-table-umbrella system
to easily and conveniently convert into a garden bench, two tool-organizing caddies, and an adjustable umbrella;

d) Can rotatably allow the unique portable and foldable five-device-in-one kneeler-bench-caddy-table-umbrella system
to easily and conveniently convert into two multi-purpose tables, two tool-organizing caddies, and an adjustable umbrella;

e) Can rotatably allow the unique portable and foldable five-device-in-one kneeler-bench-caddy-table-umbrella system
to easily and conveniently convert into two tool-organizing caddies, an adjustable umbrella, and a garden kneeler, a garden bench, or two multi-purpose tables;

f) Are convenient and user-friendly;

g) Are easily operated;

h) Are reliable;

i) Save materials;

j) Save production costs;

k) Save labor, time, and money; and l) Promote happy customers by passing savings down to consumers.

Other objects and advantages of the present invention will become apparent from a consideration of the accompanying drawings and ensuing description.

SUMMARY OF THE INVENTION

Figure 1A:
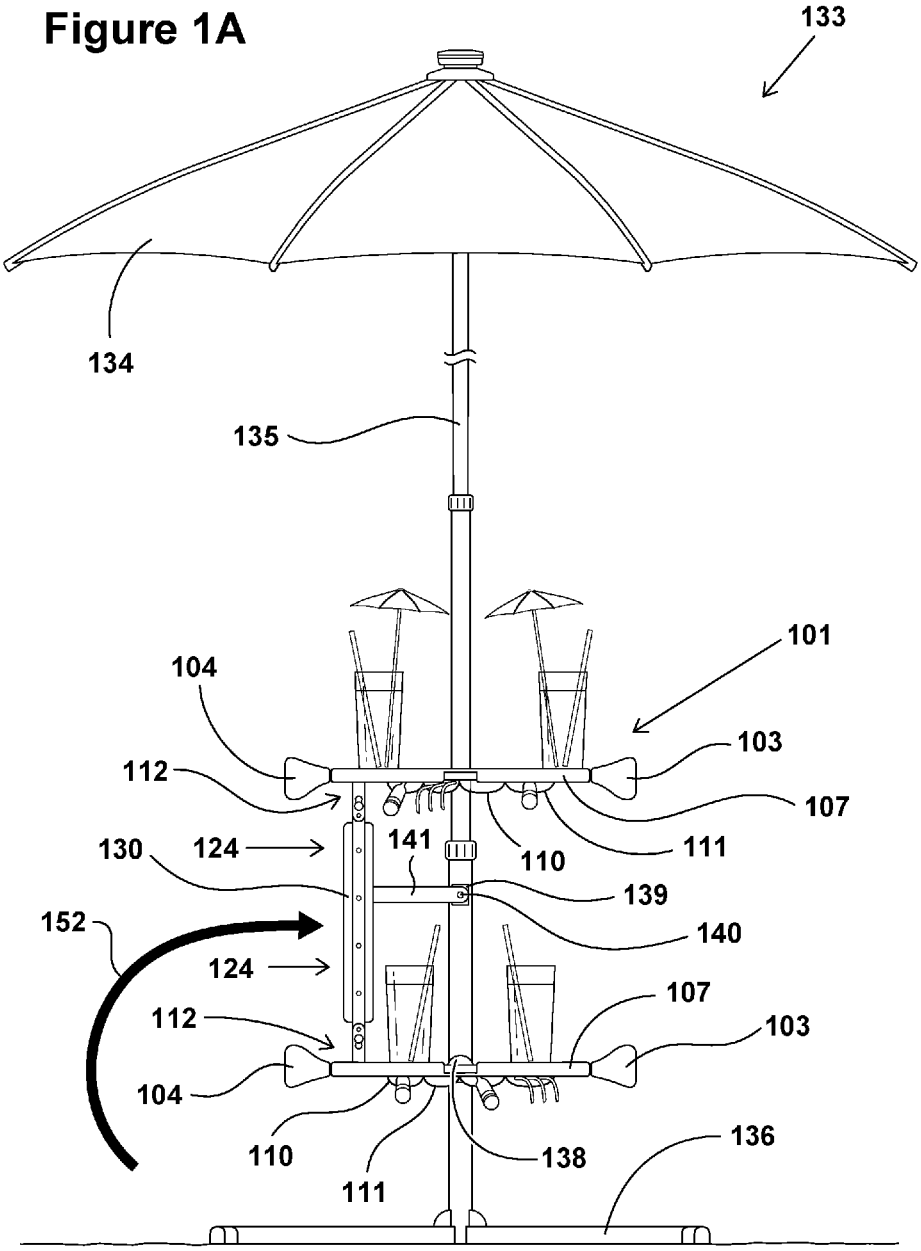
FIG. 1A illustrates a front view of the unique portable and foldable five-device-in-one system of a garden kneeler, a garden bench, garden caddies, garden tables, and a garden umbrella.
Figure 1B:
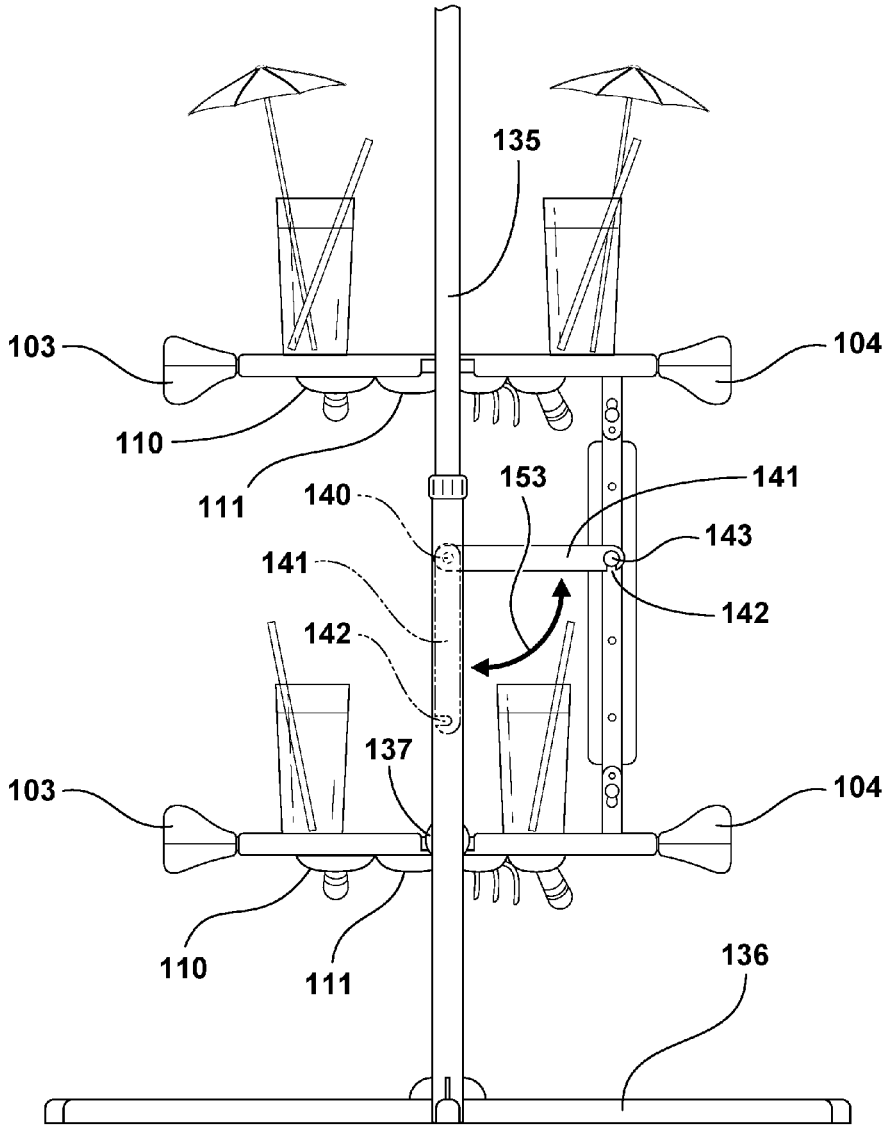
FIG. 1B illustrates a rear view of the unique portable and foldable five-device-in-one system of a garden kneeler, a garden bench, garden caddies, garden tables, and a garden umbrella, functioning as a garden umbrella and two garden tables.
Figure 2:
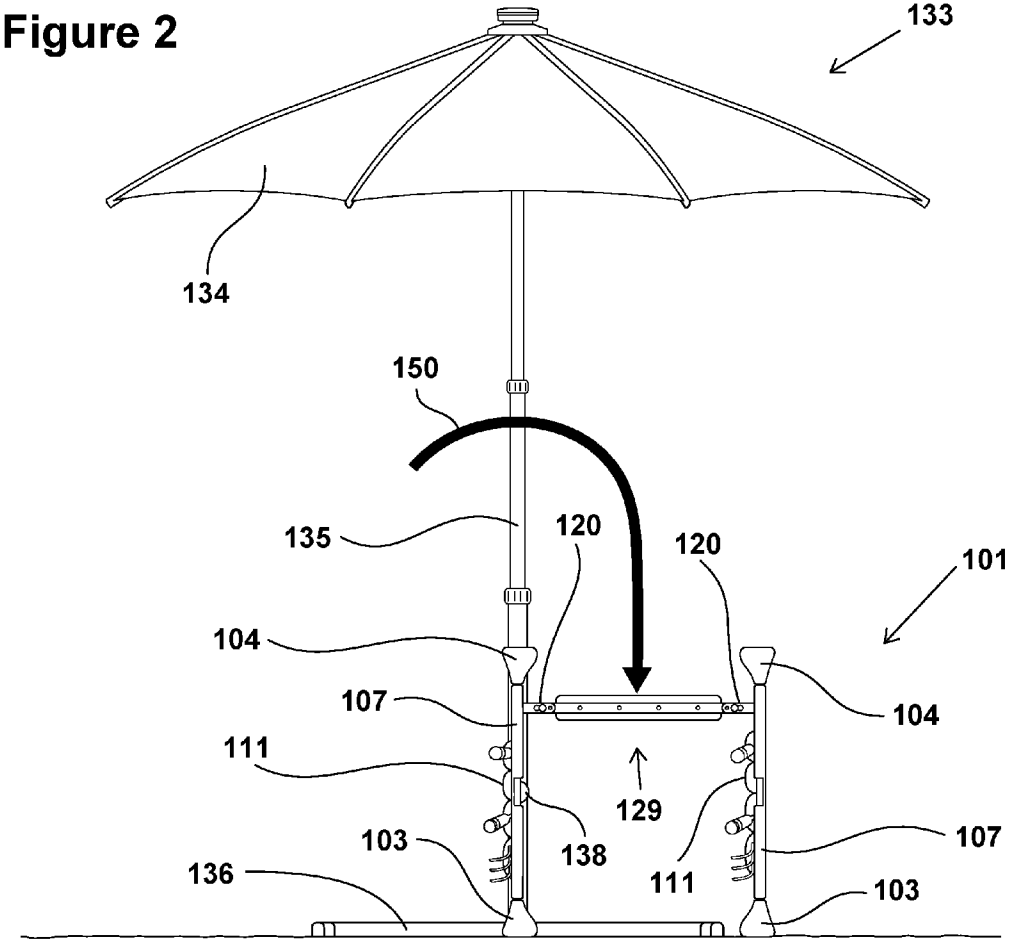
FIG. 2 illustrates a front view of the unique portable and foldable five-device-in-one system, functioning as a garden umbrella and a garden bench.
Figure 3:
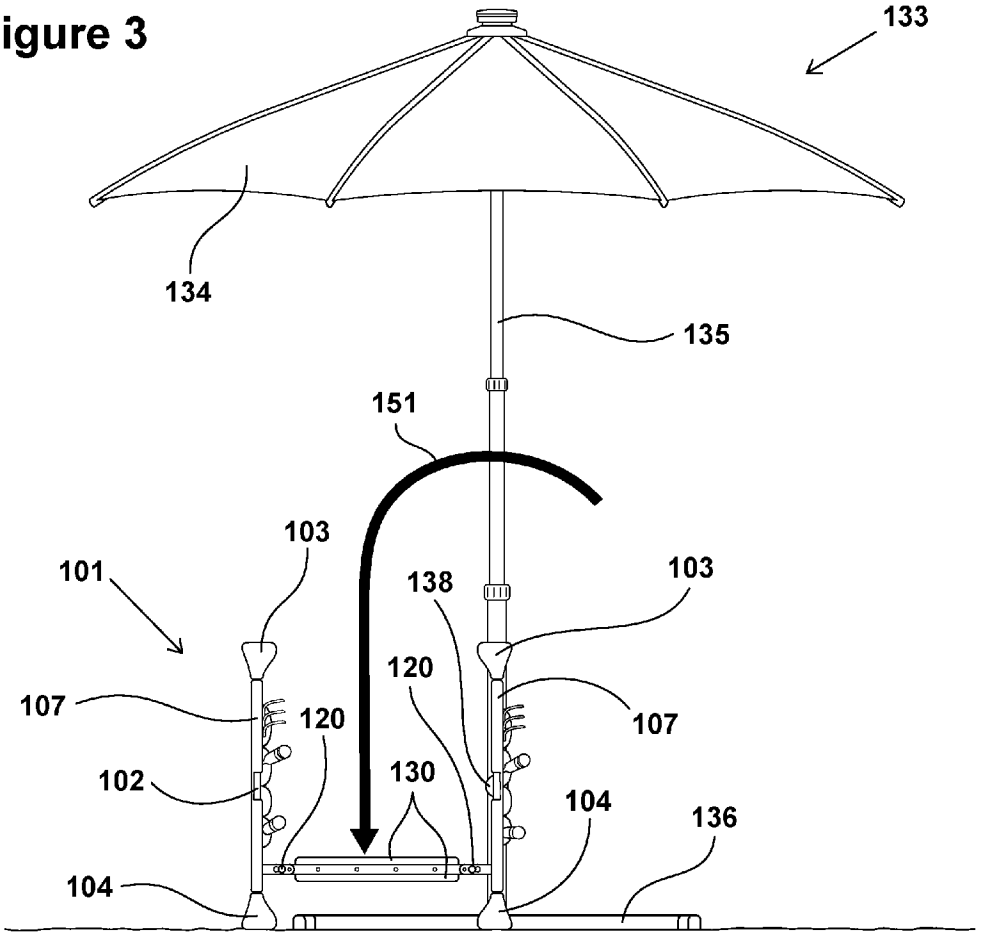
FIG. 3 illustrates a front view of the unique portable and foldable five-device-in-one system, functioning as a garden umbrella and a garden kneeler.
Figure 4:
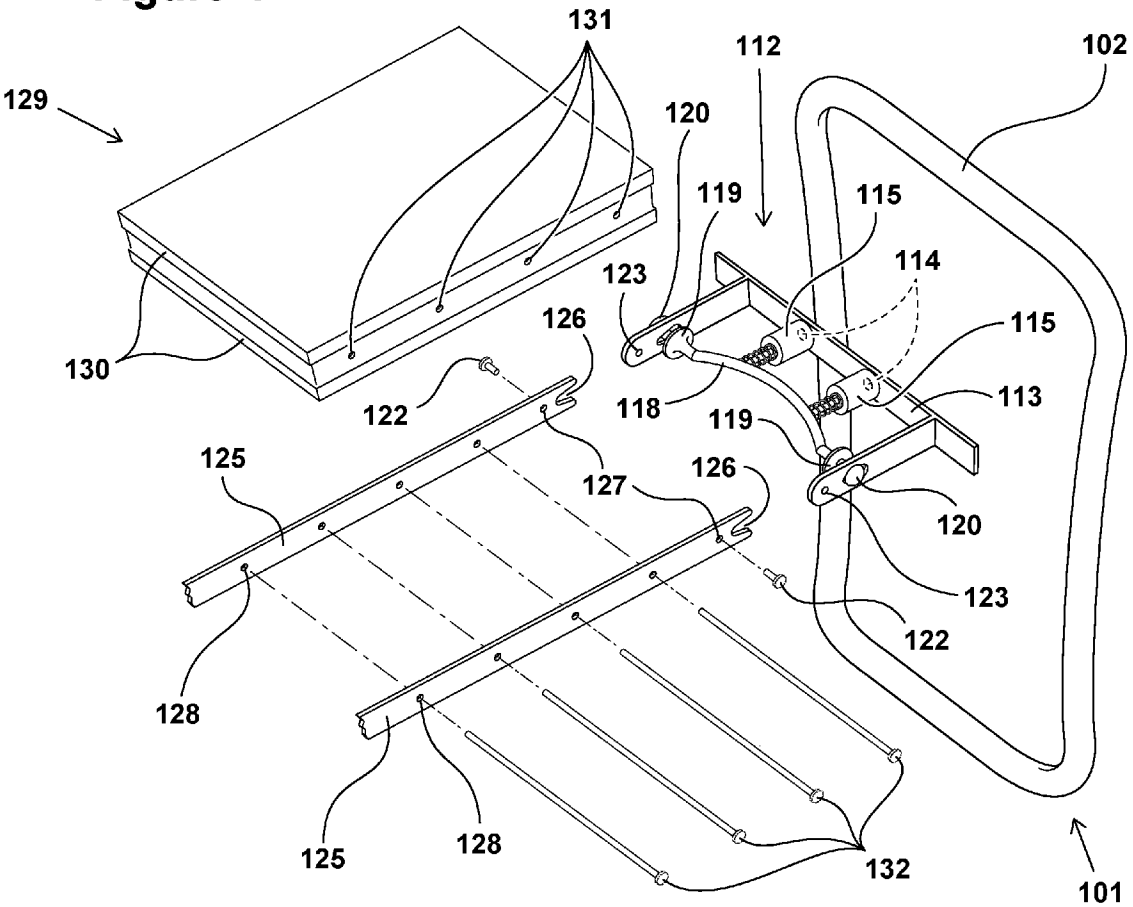
FIG. 4 illustrates a perspective view of dual-locking dual-stabilizing system, kneeler-bench-supporting head-centralizing head-locking system, and kneeler-bench-cushioning system.
Figure 5:
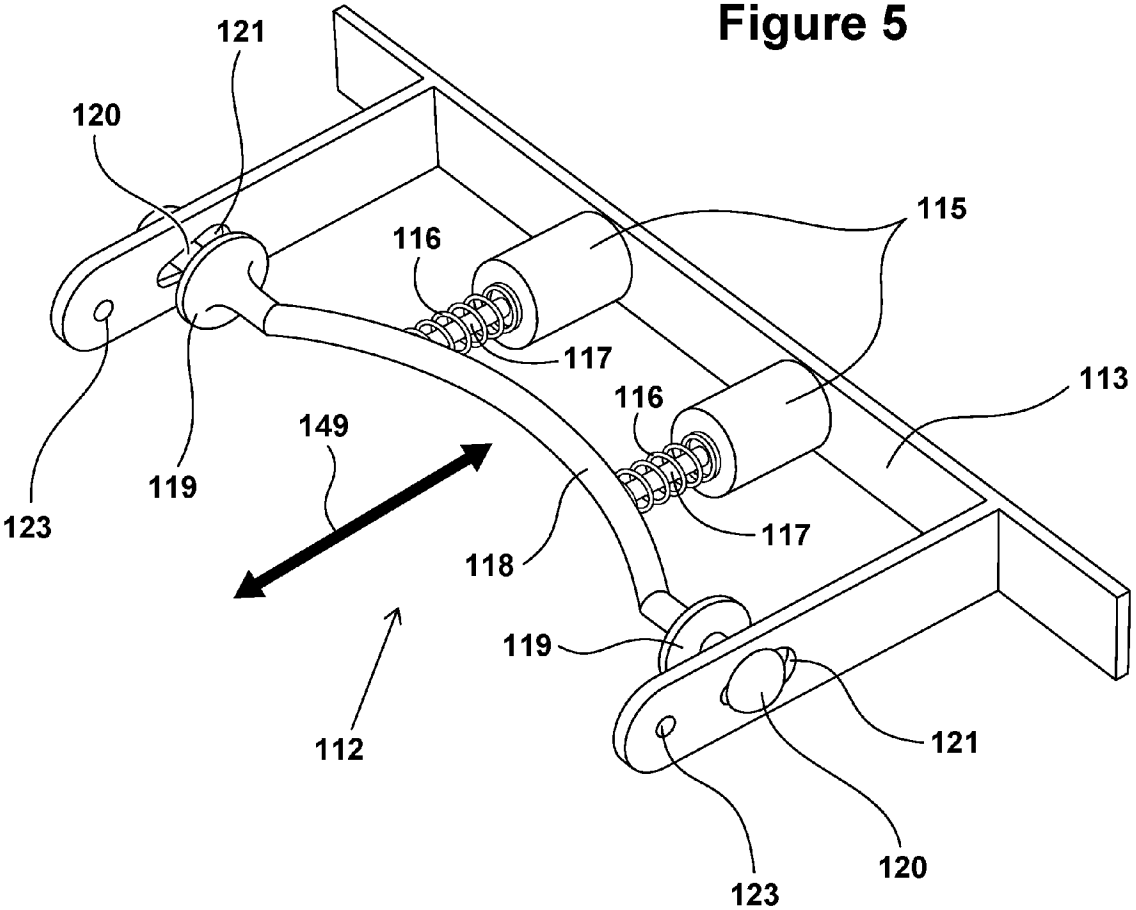
FIG. 5 illustrates a perspective view of dual-locking dual-stabilizing systems.
Figure 6:
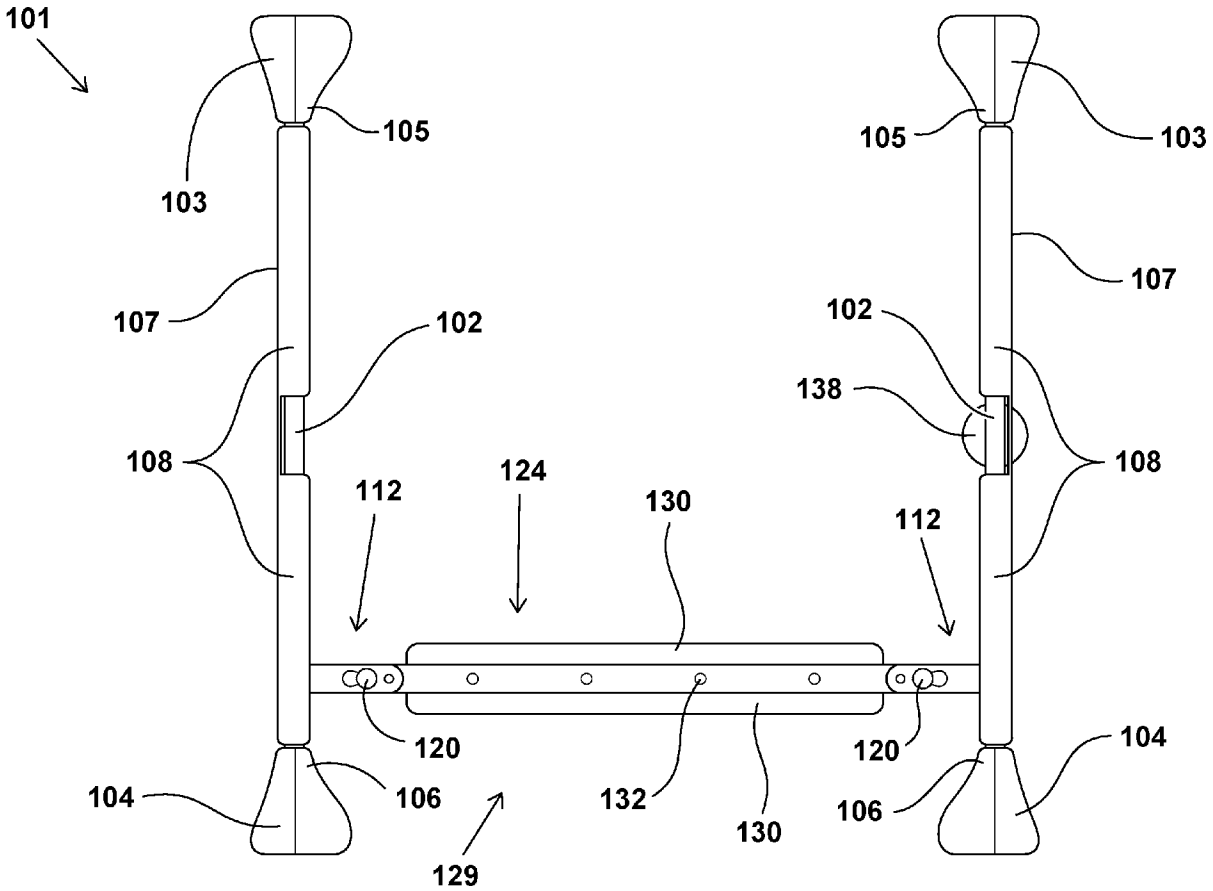
FIG. 6 illustrates a front view of two quadruple-function foot-handle-caddy-table systems, with two multi-purpose table tops snapped thereon.
Figure 7:
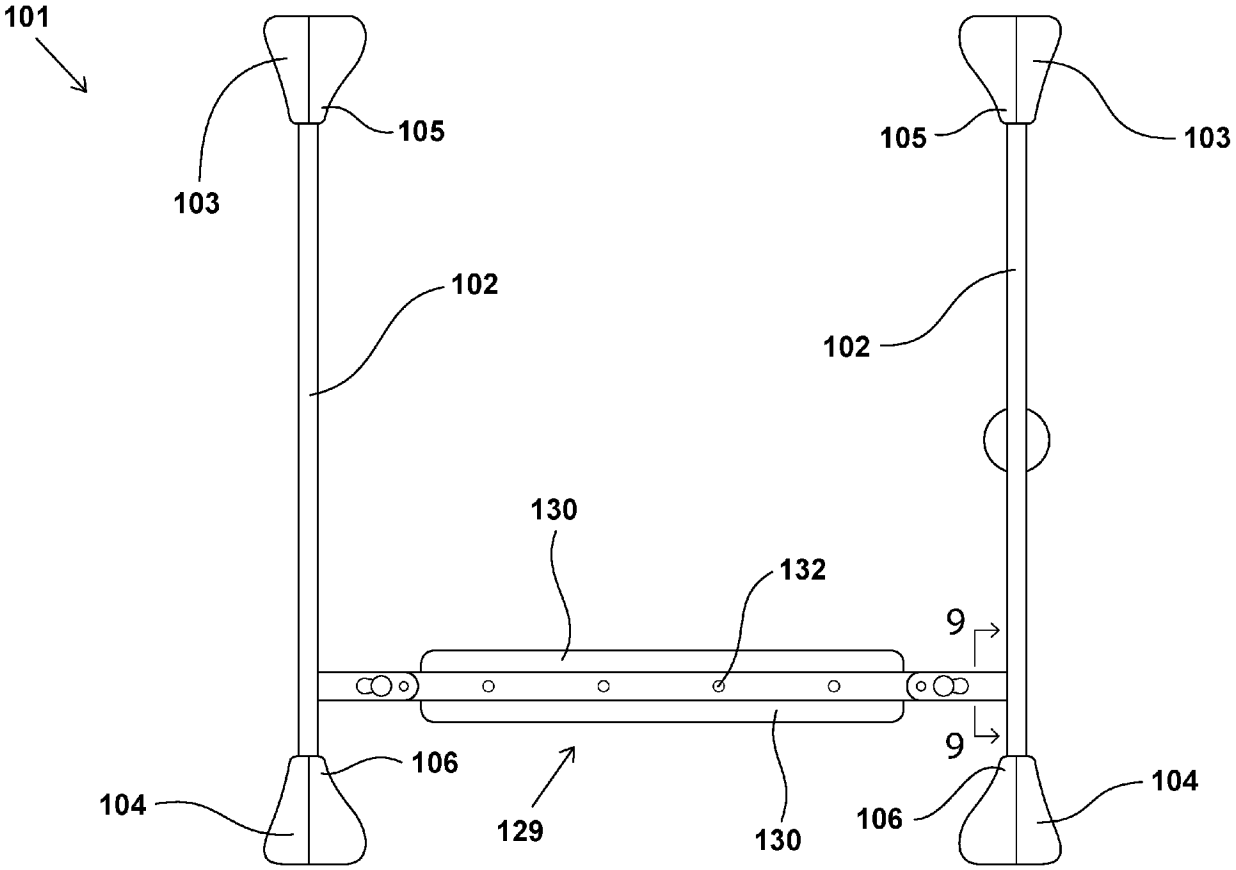
FIG. 7 illustrates a front view of two quadruple-function foot-handle-caddy-table systems, without two multi-purpose table tops snapped thereon.
Figure 9:
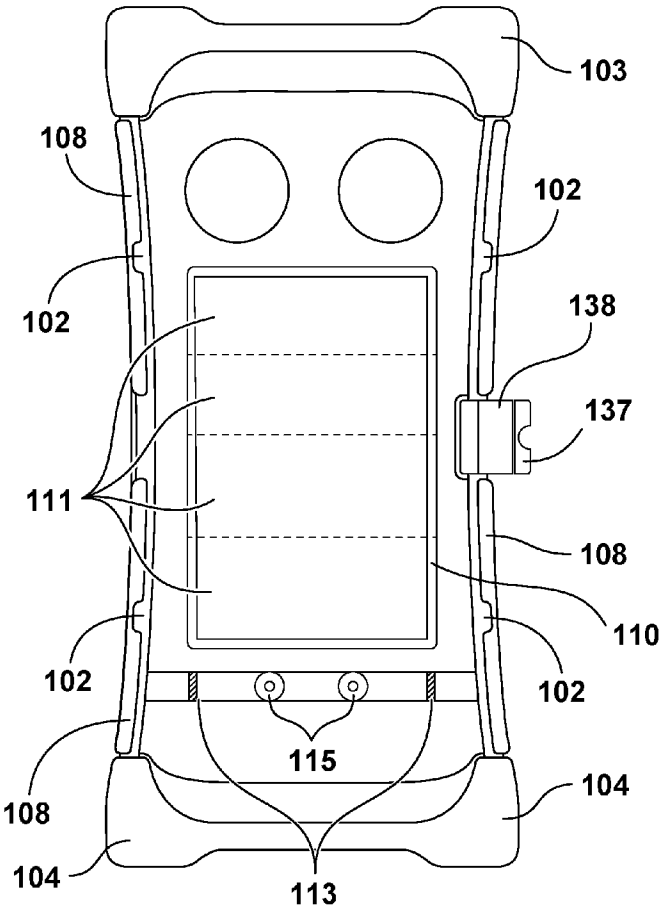
FIG. 9 illustrates a right view of a quadruple-function foot-handle-caddy-table system, with multi-purpose table tops snapped thereon (showing the underside of the multi-purpose table tops with garden-tool caddies attached thereto).
Figure 8:
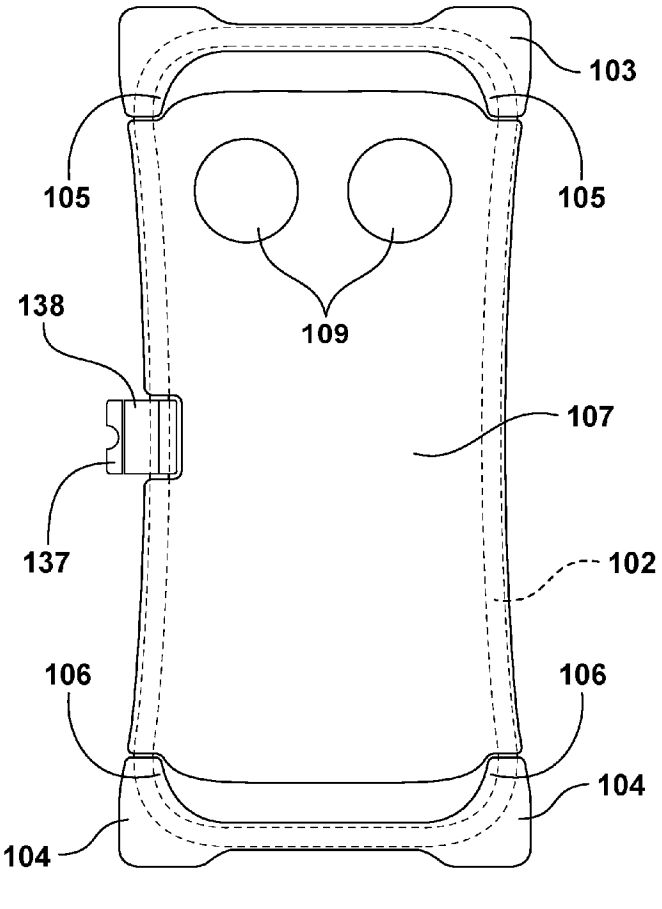
FIG. 8 illustrates a left view of a quadruple-function foot-handle-caddy-table system, with multi-purpose table tops snapped thereon (showing the upper side of the multi-purpose table tops).

A unique portable and foldable five-device-in-one system comprises: two foldable garden tables each for holding foods and drinks thereon, two foldable elastic garden-tool caddies each attached to the one of the two foldable garden tables and each for storing garden tools therein, two spring-loaded finger-centralizing stabilizers each welded to one of the two foldable garden tables and each for releasably locking the rotatable kneeler-bench cushion, a rotatable kneeler-bench cushion for providing comfort when seated or kneeled on, and an adjustable umbrella rotatably attached to one of the two foldable garden tables and having a kneeler-bench-caddy-table-locking arm for releasably locking the two foldable garden tables right side up. The unique portable and foldable five-device-in-one system can be used as an adjustable umbrella when providing shading protection, as two foldable garden-tool caddies when the two foldable caddies store garden tools, as a rotatable garden kneeler when the rotatable kneeler-bench cushion is upside down, as a rotatable garden bench when the rotatable kneeler-bench cushion is right side up, and as two foldable garden tables when the two foldable garden tables are locked right side up.

DETAILED DESCRIPTION OF THE INVENTION

Component

The unique portable and foldable five-device-in-one system has:

1) A kneeler system,
2) A bench system,
3) Multi-caddy system,
4) Multi-table system, and
5) A kneeler-bench-caddy-table-locking umbrella system.

Referring to FIGS. 1A, 1B, 2, 3, 4, 5, 6, 7, 8, 9, 10A, and 10B, the unique portable and foldable five-device-in-one system of a garden kneeler, a garden bench, multiple garden caddies, multiple garden tables, and a garden umbrella, comprises:

1) Two quadruple-function foot-handle-caddy-table systems 101, each comprising:
2) A foot-handle-caddy-table O-frame 102,
3) First dual-function foot-handle 103,
4) Second dual-function foot-handle 104,
5) First foot-handle clamps 105,
6) Second foot-handle clamps 106,
7) A multi-purpose table top 107,
8) Multiple table-top clamps 108,
9) Multiple cup-holder openings 109,
10) An elastic garden-tool caddy 110,
11) Garden-tool-caddy pockets 111;
12) Two dual-locking dual-stabilizing systems 112, each comprising:
13) A dual-locking dual-stabilizing U-frame 113,
14) Two stabilizing holes 114,
15) Two piston stabilizers 115,
16) Two locking springs 116,
17) Two locking pistons 117,
18) A finger-centralizing curved bar 118,
19) Two finger-protecting shields 119,
20) Two locking heads 120,
21) Two head-centralizing head-locking jam-preventing holes 121,
22) Two rotational rivets 122,
23) Two U-frame rivet holes 123;
24) Two kneeler-bench-supporting head-centralizing head-locking systems 124, each comprising:
25) A kneeler-bench-supporting head-centralizing head-locking I-bar 125, 26) Two head-centralizing head-locking jam-preventing recesses 126,
27) Two I-bar rivet holes 127,
28) Cushion-supporting-cross-bar holes 128;
29) A kneeler-bench-cushioning system 129, comprising:
30) A dual-function cushion 130,
31) Cushion holes 131,
32) Cushion-supporting cross-bars 132;
33) A kneeler-bench-caddy-table-locking umbrella system 133, comprising:
34) A lockable foldable canopy system 134,
35) A lockable telescopic post system 135,
36) A lockable foldable leg system 136,
37) A kneeler-bench-caddy-table-attaching base 137,
38) A kneeler-bench-caddy-table-attaching clamp 138,
39) A kneeler-bench-caddy-table-locking stabilizer 139,
40) A kneeler-bench-caddy-table-locking rivet 140,
41) A kneeler-bench-caddy-table-locking arm 141,
42) An arm-locking recess 142,
43) An arm-locking button 143,
44) A dual-sitting dual-bench-attaching buttons 144 (see FIG. 12); and
45) A kneeler-bench-caddy-table-umbrella-carrying system 145 (see FIG. 11C), comprising:
46) A carrying bag 146,
47) A zipper 147,
48) Two straps 148.

Material

Referring to FIGS. 1A, 1B, 2, 3, 4, 5, 6, 7, 8, 9, 10A, and 10B:

1) Quadruple-function foot-handle-caddy-table systems 101 each are made of metallic material, plastic material, and fabric materials.
2) Foot-handle-caddy-table O-frame 102 is made of metallic material.
3) First dual-function foot-handle 103 is made of plastic material.
4) Second dual-function foot-handle 104 is made of plastic material.
5) First foot-handle clamps 105 each are made of plastic material.
6) Second foot-handle clamps 106 each are made of plastic material.
7) Multi-purpose table top 107 is made of plastic material.
8) Table-top clamps 108 each are made of plastic material.
9) Cup-holder openings 109 each are made of empty space.
10) Elastic garden-tool caddy 110 is made of elastic material.
11) Garden-tool-caddy pockets 111 each are made of elastic material.
12) Dual-locking dual-stabilizing systems 112 each are made of metallic material.
13) Dual-locking dual-stabilizing U-frame 113 is made of metallic material.
14) Stabilizing holes 114 each are made of empty space.
15) Piston stabilizers 115 each are made of metallic material.
16) Locking springs 116 each are made of metallic material.
17) Locking pistons 117 each are made of metallic material.
18) Finger-centralizing curved bar 118 is made of metallic material.
19) Finger-protecting shields 119 each are made of metallic material.
20) Locking heads 120 each are made of metallic material.
21) Head-centralizing head-locking jam-preventing holes 121 each are made of empty space.
22) Rotational rivets 122 each are made of metallic material.
23) U-frame rivet holes 123 each are made of empty space.
24) Kneeler-bench-supporting head-centralizing head-locking systems 124 each are made of metallic material.
25) Kneeler-bench-supporting head-centralizing head-locking I-bar 125 is made of metallic material.
26) Head-centralizing head-locking jam-preventing recesses 126 each are made of empty space.
27) I-bar rivet holes 127 each are made of empty space.
28) Cushion-supporting-cross-bar holes 128 each are made of empty space.
29) Kneeler-bench-cushioning system 129 is made of foam material, vinyl material, and metallic material.
30) Dual-function cushion 130 is made of foam material and vinyl material.
31) Cushion holes 131 each are made of empty space.
32) Cushion-supporting cross-bars 132 each are made of metallic material.
33) Kneeler-bench-caddy-table-locking umbrella system 133 is made of nylon material, plastic material, and metallic material.
34) Lockable foldable canopy system 134 is made of nylon material, plastic material, and metallic material.
35) Lockable telescopic post system 135 is made of plastic material and/or metallic material.
36) Lockable foldable leg system 136 is made of plastic material and/or metallic material.
37) Kneeler-bench-caddy-table-attaching base 137 is made of plastic material and/or metallic material.
38) Kneeler-bench-caddy-table-attaching clamp 138 is made of plastic material and/or metallic material.
39) Kneeler-bench-caddy-table-locking stabilizer 139 is made of plastic material and/or metallic material.
40) Kneeler-bench-caddy-table-locking rivet 140 is made of plastic material and/or metallic material.
41) Kneeler-bench-caddy-table-locking arm 141 is made of plastic material and/or metallic material.
42) Arm-locking recess 142 is made of empty space.
43) Arm-locking button 143 is made of plastic material and/or metallic material.
44) Dual-sitting dual-bench-attaching buttons 144 each are made of plastic material and/or metallic material.
45) Kneeler-bench-caddy-table-umbrella-carrying system 145 is made of nylon material and plastic material.
46) Carrying bag 146 is made of nylon material.
47) Zipper 147 is made of plastic material.
48) Straps 148 each are made of nylon material.

Shape

Referring to FIGS. 1A, 1B, 2, 3, 4, 5, 6, 7, 8, 9, 10A, and 10B:

1) Quadruple-function foot-handle-caddy-table systems 101, each have a combined shape of its components.
2) Foot-handle-caddy-table O-frame 102 has a rectangular shape with a tubular cross-section.
3) First dual-function foot-handle 103 has a bone shape.
4) Second dual-function foot-handle 104 has a bone shape.
5) First foot-handle clamps 105 each have a C shape.
6) Second foot-handle clamps 106 each have a C shape.
7) Multi-purpose table top 107 has a rectangular shape.
8) Table-top clamps 108 each have a C shape.
9) Cup-holder openings 109 each have a round shape.
10) Elastic garden-tool caddy 110 has a rectangular shape.
11) Garden-tool-caddy pockets 111 each have a rectangular shape.
12) Dual-locking dual-stabilizing systems 112, each have a combined shape of its components.
13) Dual-locking dual-stabilizing U-frame 113 has a U shape.
14) Stabilizing holes 114 each have a round shape.

15) Piston stabilizers 115 each have a cylindrical shape.
16) Locking springs 116 each have a spring shape.
17) Locking pistons 117 each have a rod shape.
18) Finger-centralizing curved bar 118 has an arch shape.
19) Finger-protecting shields 119 each have a washer shape.
20) Locking heads 120 each have a mushroom shape.
21) Head-centralizing head-locking jam-preventing holes 121 each have a teardrop shape.
22) Rotational rivets 122 each have a rivet shape.
23) U-frame rivet holes 123 each have a round shape.
24) Kneeler-bench-supporting head-centralizing head-locking systems 124, each have a combined shape of its components.
25) Kneeler-bench-supporting head-centralizing head-locking I-bar 125 has an elongated bar shape.
26) Head-centralizing head-locking jam-preventing recesses 126 each have a V shape.
27) I-bar rivet holes 127 each have a round shape.
28) Cushion-supporting-cross-bar holes 128 each have a round shape.
29) Kneeler-bench-cushioning system 129 has a combined shape of its components.
30) Dual-function cushion 130 has a rectangular-brick shape.
31) Cushion holes 131 each have a round shape.
32) Cushion-supporting cross-bars 132 each have an elongated-rivet shape.
33) Kneeler-bench-caddy-table-locking umbrella system 133 has a combined shape of its components.
34) Lockable foldable canopy system 134 has an upside-down bowl shape.
35) Lockable telescopic post system 135 has a modupar-tube shape.
36) Lockable foldable leg system 136 has a star-fish shape.
37) Kneeler-bench-caddy-table-attaching base 137 has a puck shape with a curved bottom.
38) Kneeler-bench-caddy-table-attaching clamp 138 has a C shape.
39) Kneeler-bench-caddy-table-locking stabilizer 139 has a puck shape with a curved bottom.
40) Kneeler-bench-caddy-table-locking rivet 140 has a rivet shape.
41) Kneeler-bench-caddy-table-locking arm 141 has a rectangular shape with rounded corners.
42) Arm-locking recess 142 has a cul-de-sac shape.
43) Arm-locking button 143 has a mushroom shape.
44) Dual-sitting dual-bench-attaching buttons 144 each have a mushroom shape.
45) Kneeler-bench-caddy-table-umbrella-carrying system 145 has a combined shape of its components.
46) Carrying bag 146 has a tubular shape with two opposite closed ends.
47) Zipper 147 has a zipper shape.
48) Straps 148 each have a rectangular shape.

Connection

Referring to FIGS. 1A, 1B, 2, 3, 4, 5, 6, 7, 8, 9, 10A, and 10B:

1) Quadruple-function foot-handle-caddy-table systems 101 each are detachably and rotatably attached to lockable telescopic post system 135.
2) Foot-handle-caddy-table O-frame 102 is detachably and rotatably attached to lockable telescopic post system 135.
3) First dual-function foot-handle 103 is snapped on foot-handle-caddy-table O-frame 102 at one of its two opposite ends.
4) Second dual-function foot-handle 104 is snapped onto foot-handle-caddy-table O-frame 102 at another one of its two opposite ends.
5) First foot-handle clamps 105 each are molded to first dual-function foot-handle 103,
6) Second foot-handle clamps 106 each are molded to second dual-function foot-handle 104.
7) Multi-purpose table top 107 is snapped on foot-handle-caddy-table O-frame 102.
8) Table-top clamps 108 each are molded to multi-purpose table top 107.
9) Cup-holder openings 109 each are molded into multi-purpose table top 107.
10) Elastic garden-tool caddy 110 is attached to the underside of multi-purpose table top 107.
11) Garden-tool-caddy pockets 111 each are attached to the underside of multi-purpose table top 107.
12) Dual-locking dual-stabilizing systems 112 each are welded to one foot-handle-caddy-table O-frame 102, and each are riveted to two kneeler-bench-supporting head-centralizing head-locking I-bar 125.
13) Dual-locking dual-stabilizing U-frame 113 is welded to foot-handle-caddy-table O-frame 102.
14) Stabilizing holes 114 each are drilled into dual-locking dual-stabilizing U-frame 113.
15) Piston stabilizers 115 each are welded to dual-locking dual-stabilizing U-frame 113.
16) Locking springs 116 each are slid on one locking piston 117.
17) Locking pistons 117 each are inserted into one piston stabilizer 115.
18) Finger-centralizing curved bar 118 is welded to locking pistons 117.
19) Finger-protecting shields 119 each are molded to finger-centralizing curved bar 118 at one of its two opposite ends.
20) Locking heads 120 each are molded to finger-centralizing curved bar 118 at one of its two opposite ends.
21) Head-centralizing head-locking jam-preventing holes 121 each are drilled into dual-locking dual-stabilizing U-frame 113.
22) Rotational rivets 122 each are riveted to dual-locking dual-stabilizing U-frame 113.
23) U-frame rivet holes 123 each are drilled into dual-locking dual-stabilizing U-frame 113.
24) Kneeler-bench-supporting head-centralizing head-locking systems 124 each are riveted to two dual-locking dual-stabilizing U-frames 113.
25) Kneeler-bench-supporting head-centralizing head-locking I-bar 125 is riveted to two dual-locking dual-stabilizing U-frames 113.
26) Head-centralizing head-locking jam-preventing recesses 126 each are molded to kneeler-bench-supporting head-centralizing head-locking I-bar 125 at one of its two opposite ends.
27) I-bar rivet holes 127 each are drilled into kneeler-bench-supporting head-centralizing head-locking I-bar 125.
28) Cushion-supporting-cross-bar holes 128 each are drilled through dual-function cushion 130.
29) Kneeler-bench-cushioning system 129 is riveted to two kneeler-bench-supporting head-centralizing head-locking I-bar 125.
30) Dual-function cushion 130 is riveted to two kneeler-bench-supporting head-centralizing head-locking I-bar 125.
31) Cushion holes 131 each are molded into dual-function cushion 129.

32) Cushion-supporting cross-bars 132 each are inserted through and riveted to two kneeler-bench-supporting head-centralizing head-locking I-bar 125 and dual-function cushion 130.

33) Kneeler-bench-caddy-table-locking umbrella system 133 is detachably and rotatably attached to foot-handle-caddy-table O-frame 102.

34) Lockable foldable canopy system 134 is attached to lockable telescopic post system 135.

35) Lockable telescopic post system 135 is attached to lockable foldable leg system 136.

36) Lockable foldable leg system 136 is attached to lockable telescopic post system 135.

37) Kneeler-bench-caddy-table-attaching base 137 is detachably and rotatably attached to lockable telescopic post system 135.

38) Kneeler-bench-caddy-table-attaching clamp 138 is detachably and rotatably attached to kneeler-bench-caddy-table-attaching base 137.

39) Kneeler-bench-caddy-table-locking stabilizer 139 is attached to lockable telescopic post system 135.

40) Kneeler-bench-caddy-table-locking rivet 140 is riveted through kneeler-bench-caddy-table-locking arm 141 and onto kneeler-bench-caddy-table-locking stabilizer 139.

41) Kneeler-bench-caddy-table-locking arm 141 is riveted onto kneeler-bench-caddy-table-locking stabilizer 139.

42) Arm-locking recess 142 is stamped into kneeler-bench-caddy-table-locking arm 141.

43) Arm-locking button 143 is attached to one kneeler-bench-supporting head-centralizing head-locking I-bar 125.

44) Dual-sitting dual-bench-attaching buttons 144 each are attached to one foot-handle-caddy-table O-frame 102.

45) Kneeler-bench-caddy-table-umbrella-carrying system 145 is pulled on all the above-mentioned systems 101, 112, 124, 129, and 133.

46) Carrying bag 146 is pulled on all the above-mentioned systems 101, 112, 124, 129, and 133.

47) Zipper 147 is sewn onto carrying bag 146.

48) Straps 148 each are sewn onto carrying bag 146 at its two opposite ends.

Function

Referring to FIGS. 1A, 1B, 2, 3, 4, 5, 6, 7, 8, 9, 10A, and 10B:

1) Quadruple-function foot-handle-caddy-table systems 101 each are for:
   a) Providing wide foot prints for stable contact with the ground, to stabilize the unique portable five-device-in-one system of a garden kneeler, a garden bench, garden caddies, garden tables, and a garden umbrella,
   b) Providing wide handles for a person to easily hold onto, to pull himself/herself up from his/her kneeling position,
   c) Providing a table to hold foods and refreshment, and
   d) Providing a garden-tool caddy to keep garden tools handy where a person works.

2) Foot-handle-caddy-table O-frame 102 is for:
   Supporting dual-locking dual-stabilizing systems 112, kneeler-bench-supporting head-centralizing head-locking systems 124, and kneeler-bench-cushioning system 129, 3) First dual-function foot-handle 103 is for:
   a) Providing a wide foot print for stable contact with the ground, to stabilize the unique portable five-device-in-one system of a garden kneeler, a garden bench, garden caddies, garden tables, and a garden umbrella, and
   b) Providing a wide handle for a person to easily hold onto, to pull himself/herself up from his/her kneeling position.

4) Second dual-function foot-handle 104 is for:
   a) Providing a wide foot print for stable contact with the ground, to stabilize the unique portable five-device-in-one system of a garden kneeler, a garden bench, a garden caddy, a garden table, and a garden umbrella, and
   b) Providing a wide handle for a person to easily hold onto, to pull himself/herself up from his/her kneeling position.

5) First foot-handle clamps 105 each are for:
   Clamping first dual-function foot-handle 103 on foot-handle-caddy-table O-frame 102.

6) Second foot-handle clamps 106 each are for:
   Clamping second dual-function foot-handle 104 on foot-handle-caddy-table O-frame 102.

7) Multi-purpose table top 107 is for:
   Holding foods and refreshment for people to eat and drink.

8) Table-top clamps 108 each are for:
   Clamping multi-purpose table top 107 on foot-handle-caddy-table O-frame 102.

9) Cup-holder openings 109 each are for:
   Holding beverage containers.

10) Elastic garden-tool caddy 110 is for:
   Storing garden tools or implements.

11) Garden-tool-caddy pockets 111 each are for:
   Separately storing garden tools or implements;

12) Dual-locking dual-stabilizing systems 112 each are for:
   a) Stabilizing the oscillating movement of two locking pistons 117,
   b) Aligning the oscillating movement of two locking piston 117,
   c) Stabilizing the oscillating movement of finger-centralizing curved bar 118,
   d) Aligning the oscillating movement of finger-centralizing curved bar 118,
   e) Stabilizing the oscillating movement of two locking heads 120,
   f) Aligning the oscillating movement of two locking heads 120,
   g) Centralizing locking head 120 when locking head 120 is in its locking position,
   h) Allowing foot-handle-caddy-table O-frame 102 to be folded and unfolded,
   i) Preventing a person's fingers from getting pinched by locking heads 120, and
   j) Preventing locking head 120 from getting jammed.

13) Dual-locking dual-stabilizing U-frame 113 is for:
   a) Connecting foot-handle-caddy-table O-frame 102 with kneeler-bench-supporting head-centralizing head-locking I-bar 125
   b) Providing a rotational center for folding foot-handle-caddy-table O-frame 102.

14) Stabilizing holes 114 each are for:
   Receiving locking piston 117.

15) Piston stabilizers 115 each are for:
   a) Stabilizing the oscillating movement of locking piston 117, and
   b) Aligning the oscillating movement of locking piston 117.

16) Locking springs 116 each are for:
   Pushing curved bar 118 to push locking heads 120 into head-centralizing head-locking jam-preventing holes 121.

17) Locking pistons 117 each are for:
a) Stabilizing the oscillating movement of finger-centralizing curved bar 118, and
b) Aligning the oscillating movement of finger-centralizing curved bar 118.
18) Finger-centralizing curved bar 118 is for:
Centralizing a person's fingers applied thereon, to prevent them from getting pinched by locking heads 120.
19) Finger-protecting shields 119 each are for:
a) Stabilizing the oscillating movement of finger-centralizing curved bar 118,
b) Aligning the oscillating movement of finger-centralizing curved bar 118, and
c) Preventing a person's fingers from getting pinched by locking heads 120.
20) Locking heads 120 are for:
Sliding in head-centralizing head-locking jam-preventing recesses 126 to lock foot-handle-caddy-table O-frame 102 to kneeler-bench-supporting head-centralizing head-locking I-bar 125.
21) Head-centralizing head-locking jam-preventing holes 121 each are for:
a) Centralizing locking head 120 when locking head 120 is in its locking position,
b) Locking locking head 120 therein, and
c) Preventing locking head 120 from getting jammed.
22) Rotational rivets 122 each are for:
Riveting dual-locking dual-stabilizing U-frame 113 to kneeler-bench-supporting head-centralizing head-locking I-bar 125.
23) U-frame rivet holes 123 each are for:
Receiving rotational rivet 121.
24) Kneeler-bench-supporting head-centralizing head-locking systems 124 each are for:
a) Centralizing locking head 120 when locking head 120 is in its locking position,
b) Locking locking head 120,
c) Providing a rotational center for folding foot-handle-caddy-table O-frame 102,
d) Supporting dual-function cushion 130,
e) Supporting cushion-supporting cross-bars 132, and
f) Preventing locking head 120 from getting jammed.
25) Kneeler-bench-supporting head-centralizing head-locking I-bar 125 is for:
a) Supporting dual-function cushion 130, and
b) Supporting cushion-supporting cross-bars 132.
26) Head-centralizing head-locking jam-preventing recesses 126 each are for:
a) Centralizing locking head 120 when locking head 120 is in its locking position,
b) Locking locking head 120 therein, and
c) Preventing locking head 120 from getting jammed.
27) I-bar rivet holes 127 each are for:
Receiving rotational rivet 122.
28) Cushion-supporting-cross-bar holes 128 each are for:
Receiving cushion-supporting cross-bar 132.
29) Kneeler-bench-cushioning system 129 is for:
Providing a cushion for sitting or kneeling.
30) Dual-function cushion 130 is for:
Providing a cushion for sitting or kneeling.
31) Cushion holes 131 each are for:
Receiving cushion-supporting cross-bar 132.
32) Cushion-supporting cross-bars 132 each are for:
Supporting and securing dual-function cushion 130 to two kneeler-bench-supporting head-centralizing head-locking I-bar 125.
33) Kneeler-bench-caddy-table-locking umbrella system 133 is for:
Providing an umbrella.
34) Lockable foldable canopy system 134 is for:
Providing shading protection from the sun and rain.
35) Lockable telescopic post system 135 is for:
Supporting lockable foldable canopy system 134 at different heights.
36) Lockable foldable leg system 136 is for:
Holding lockable telescopic post system 135, in an upright position.
37) Kneeler-bench-caddy-table-attaching base 137 is for:
Rotatably attaching lockable telescopic post system 135 to kneeler-bench-caddy-table-attaching clamp 138.
38) Kneeler-bench-caddy-table-attaching clamp 138 is for:
Detachably attaching kneeler-bench-caddy-table-attaching base 136 to foot-handle-caddy-table O-frame 102.
39) Kneeler-bench-caddy-table-locking stabilizer 139 is for:
Attaching lockable telescopic post system 135 to kneeler-bench-caddy-table-locking rivet 140. providing a rotational connection for Kneeler-bench-caddy-table-locking arm 141.
40) Kneeler-bench-caddy-table-locking rivet 140 is for:
Rotatably riveting kneeler-bench-caddy-table-locking arm 141 to kneeler-bench-caddy-table-locking stabilizer 139.
41) Kneeler-bench-caddy-table-locking arm 141 is for:
Locking kneeler-bench-supporting head-centralizing head-locking I-bar 125 to lockable telescopic post system 135, in an upright position.
42) Arm-locking recess 142 is for:
Receiving and locking arm-locking button 143 therein.
43) Arm-locking button 143 is for:
Locking kneeler-bench-caddy-table-locking arm 141 thereon.
44) Dual-sitting dual-bench-attaching buttons 144 each are for:
Attaching additional garden bench, to create two benches for dual sitting.
45) Kneeler-bench-caddy-table-umbrella-carrying system 145 is for:
Conveniently transporting and storing the unique portable five-device-in-one system of a garden kneeler, a garden bench, garden caddies, garden tables, and a garden umbrella.
46) Carrying bag 146 is for:
Conveniently transporting and storing the unique portable five-device-in-one system of a garden kneeler, a garden bench, garden caddies, garden tables, and a garden umbrella.
47) Zipper 147 is for:
Opening and closing carrying bag 146.
48) Straps 148 each are for:
Easily transporting carrying bag 146.

Operation

The unique portable and foldable five-device-in-one system has:
1) A kneeler system,
2) A bench system,
3) Multi-caddy system,
4) Multi-table system, and
5) A kneeler-bench-caddy-table-locking umbrella system.

Referring to FIGS. 11A, 11B, 11C, and 11D, the operation of the unique portable and foldable five-device-in-one system of a garden kneeler, a garden bench, multiple garden caddies, multiple garden tables, and a garden umbrella, comprises:

Deployment of Garden Umbrella

1) Unfolding lockable foldable leg system 136;
2) Locking lockable foldable leg system 136;
3) Extending lockable telescopic post system 135;
4) Locking lockable telescopic post system 135;
5) Unfolding lockable foldable canopy system 134; and
6) Locking lockable foldable canopy system 134
   such that while working, seating, resting, eating, and drinking under it, a person can use it to provide shading protection from the sun and rain.

Deployment of Garden Bench

1) Squeezing two finger-centralizing curved bars 118 with fingers to compress locking springs 116, in the direction of arrow 149 (FIG. 5),
   such that the fingers slide toward the middle of each finger-centralizing curved bar 118, to prevent two locking heads 120 from pinching the fingers;
2) Unfolding two foot-handle-caddy-table O-frames 102;
3) Releasing two finger-centralizing curved bars 118
   such that two locking heads 120 are pushed into and locked in two head-centralizing head-locking jam-preventing recesses 126, respectively, to prevent two locking heads 120 from getting jammed; and
4) Rotating dual-function cushion 130 until first dual-function foot-handles 103 touch the ground, in the direction of arrow 150 (FIG. 2),
   such that a person can sit on dual-function cushion 130, to use it as a bench to rest.

Deployment of Garden Kneeler and Garden-Tool Caddies

Figure 10B:
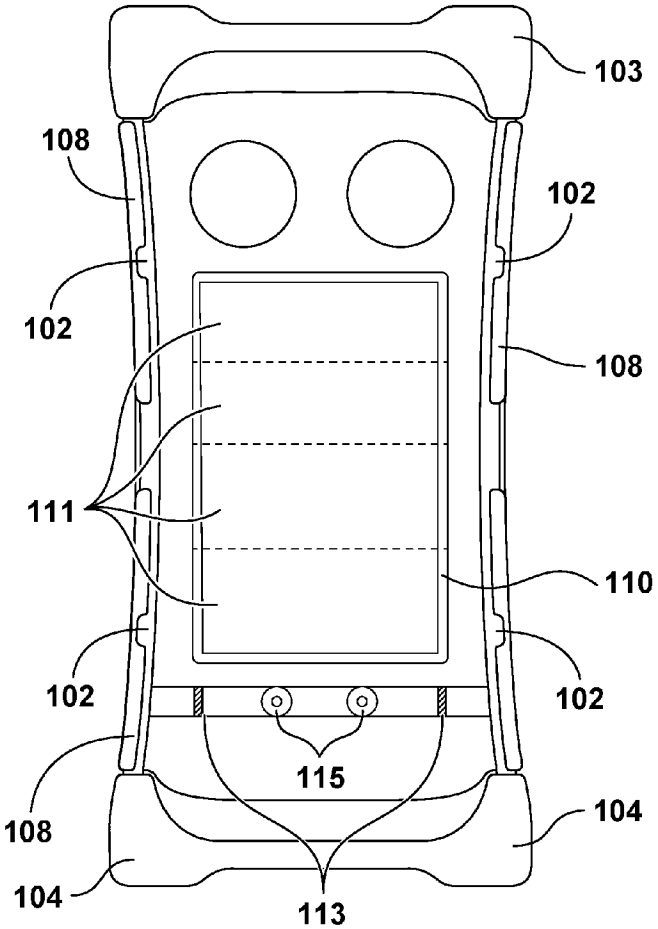
FIG. 10B illustrates a right view of another quadruple-function foot-handle-caddy-table system, with other multi-purpose table tops snapped thereon (showing the underside of multi-purpose table tops with garden-tool caddies attached thereto).
Figure 10A:
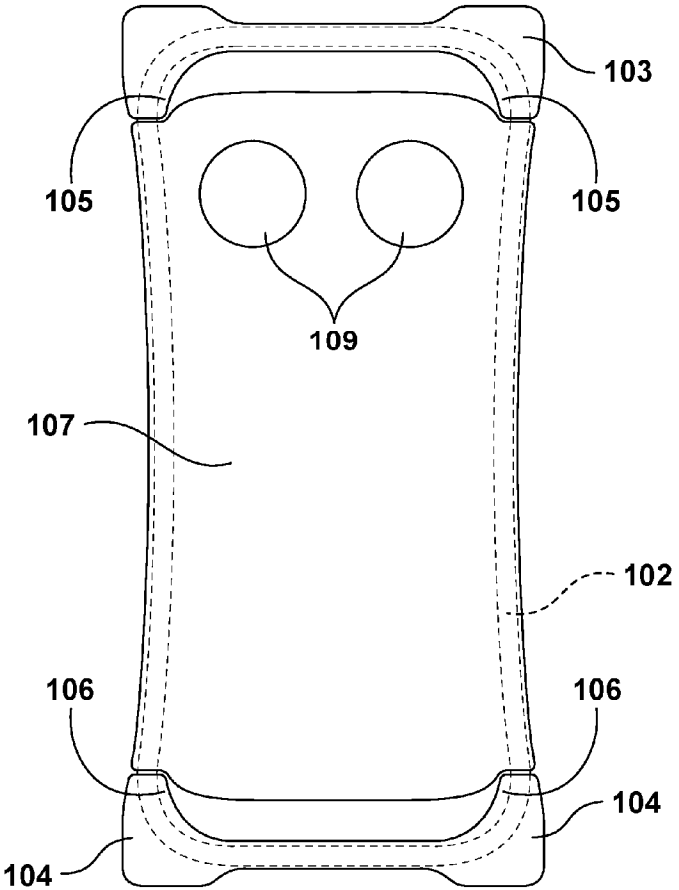
FIG. 10A illustrates a left view of another quadruple-function foot-handle-caddy-table system, with other multi-purpose table tops snapped thereon (showing the upper side of the multi-purpose table tops).

Rotating dual-function cushion 130 until second dual-function foot-handles 104 touch the ground, in the direction of arrow 151 (FIG. 3),
   such that a person can kneel on dual-function cushion 130, to use it as a kneeler to work, and to use garden tools conveniently stored in elastic garden-tool caddies 110 (see elastic garden-tool caddies 110 and garden-tool-caddy pockets 111 in FIGS. 1A and 10B).

Deployment of Garden Multi-Purpose Tables

1) Rotating multi-purpose table tops 107 until they are at a right angle with lockable telescopic post system 135, in the direction of arrow 152 (FIG. 1A); and
2) Rotating kneeler-bench-caddy-table-locking arm 141 until arm-locking button 143 is slid in and locked in arm-locking recess 142, in the direction of arrow 153 (FIG. 1B),
   such that multi-purpose table tops 107 can be used to hold foods and refreshment for people to eat and drink.

Retraction of the Unique Portable and Foldable Five-Device-in-One System

Figures 11A, 11B:
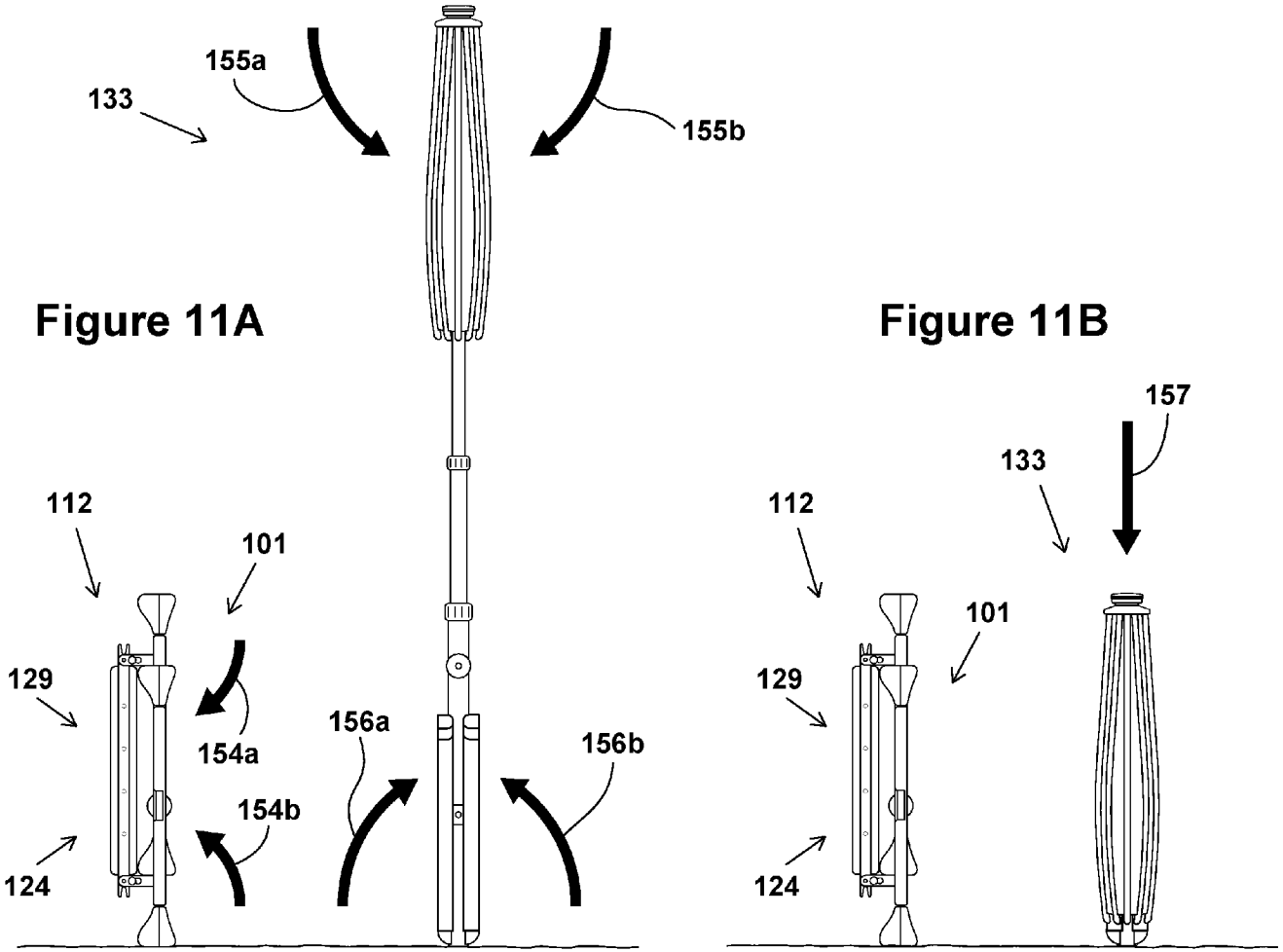
FIGS. 11A and 11B illustrate a front view of the unique portable and foldable five-device-in-one system, being folded and retracted.
Figure 11D:
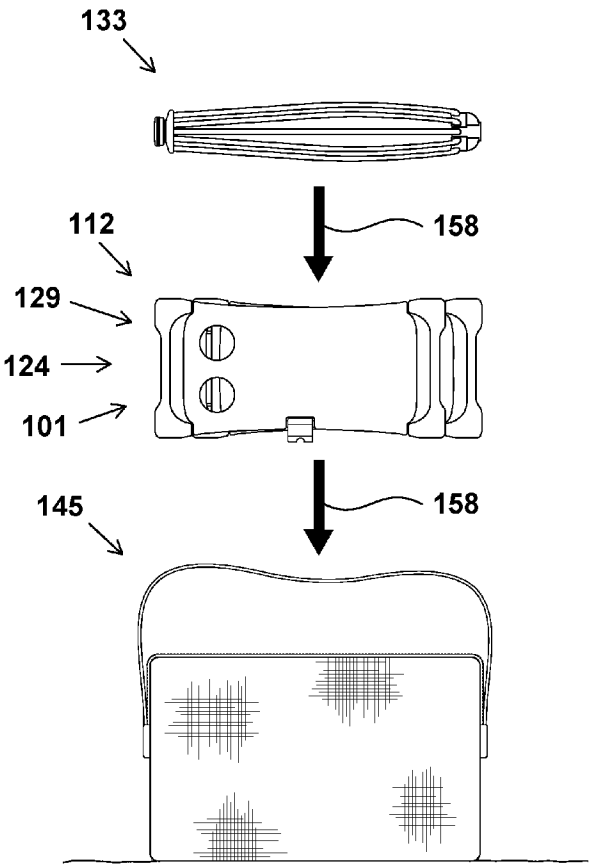
FIGS. 11C and 11D illustrate a front view of the unique portable and foldable five-device-in-one system, being snapped apart and put in a carrying bag for transportation and storage.
Figure 11C:
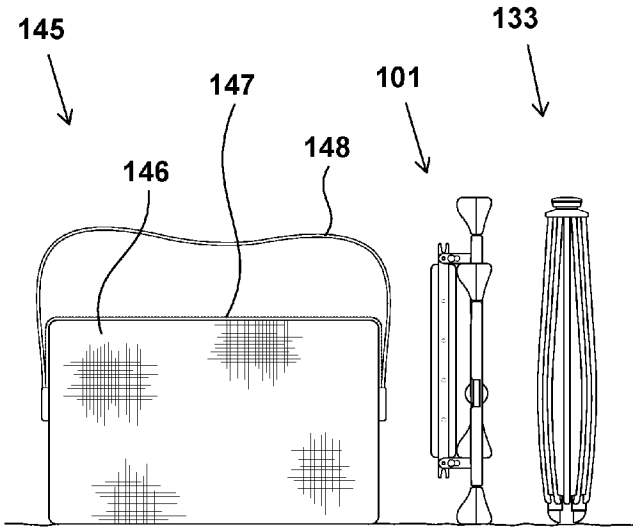

1) Rotating kneeler-bench-caddy-table-locking arm 141 until arm-locking button 143 is slid out of arm-locking recess 142;
2) Squeezing two finger-centralizing curved bars 118 with fingers to compress locking springs 116
   such that the fingers slide toward the middle of each finger-centralizing curved bar 118, to prevent two locking heads 120 from pinching the fingers;
3) Folding two foot-handle-caddy-table O-frames 102, in the directions of arrows 154*a* and 154*b* (FIG. 11A);
4) Releasing two finger-centralizing curved bars 119
   such that two locking heads 120 are pushed into two head-centralizing head-locking jam-preventing holes 121, respectively, to prevent two locking heads 120 from getting jammed;
5) Rotating dual-function cushion 130 until it is parallel with lockable telescopic post system 135;
6) Unlocking lockable foldable canopy system 134;
7) Folding lockable foldable canopy system 134, in the directions of arrows 155*a* and 155*b* (FIG. 11A);
8) Unlocking lockable foldable leg system 136;
9) Folding lockable foldable leg system 136, in the directions of arrows 156*a* and 156*b* (FIG. 11A);
10) Unlocking lockable telescopic post system 135; and
11) Retracting lockable telescopic post system 135, in the direction of arrow 157 (FIG. 11B).

Storage of the Unique Portable and Foldable Five-Device-in-One System

1) Placing quadruple-function foot-handle-caddy-table systems 101, dual-locking dual-stabilizing systems 112, kneeler-bench-supporting head-centralizing head-locking systems 124, kneeler-bench-cushioning system 129, and kneeler-bench-caddy-table-locking umbrella system 133 inside carrying bag 146,
   in the direction of arrow 158 (FIGS. 11C and 11D); and
2) Zipping zipper 147
   such that the unique portable and foldable five-device-in-one system of a garden kneeler, a garden bench, garden caddies, garden tables, and a garden umbrella can easily and conveniently be transported and stored anywhere.

Variation

Foot-handle-caddy-table O-frame 102 can have a cross-section of different shapes, for example, square, rectangular, oval, etc.

Dual-locking dual-stabilizing U-frame 113 can have different cross-sections, for example, round, square, rectangular, oval, etc.

Dual-locking dual-stabilizing U-frame 113 can have a tube-like cross-section.

Kneeler-bench-supporting head-centralizing head-locking I-bar 125 can have different cross-sections, for example, round, square, rectangular, oval, etc.

Kneeler-bench-supporting head-centralizing head-locking I-bar 125 can have a tube-like cross-section.

Figure 12:
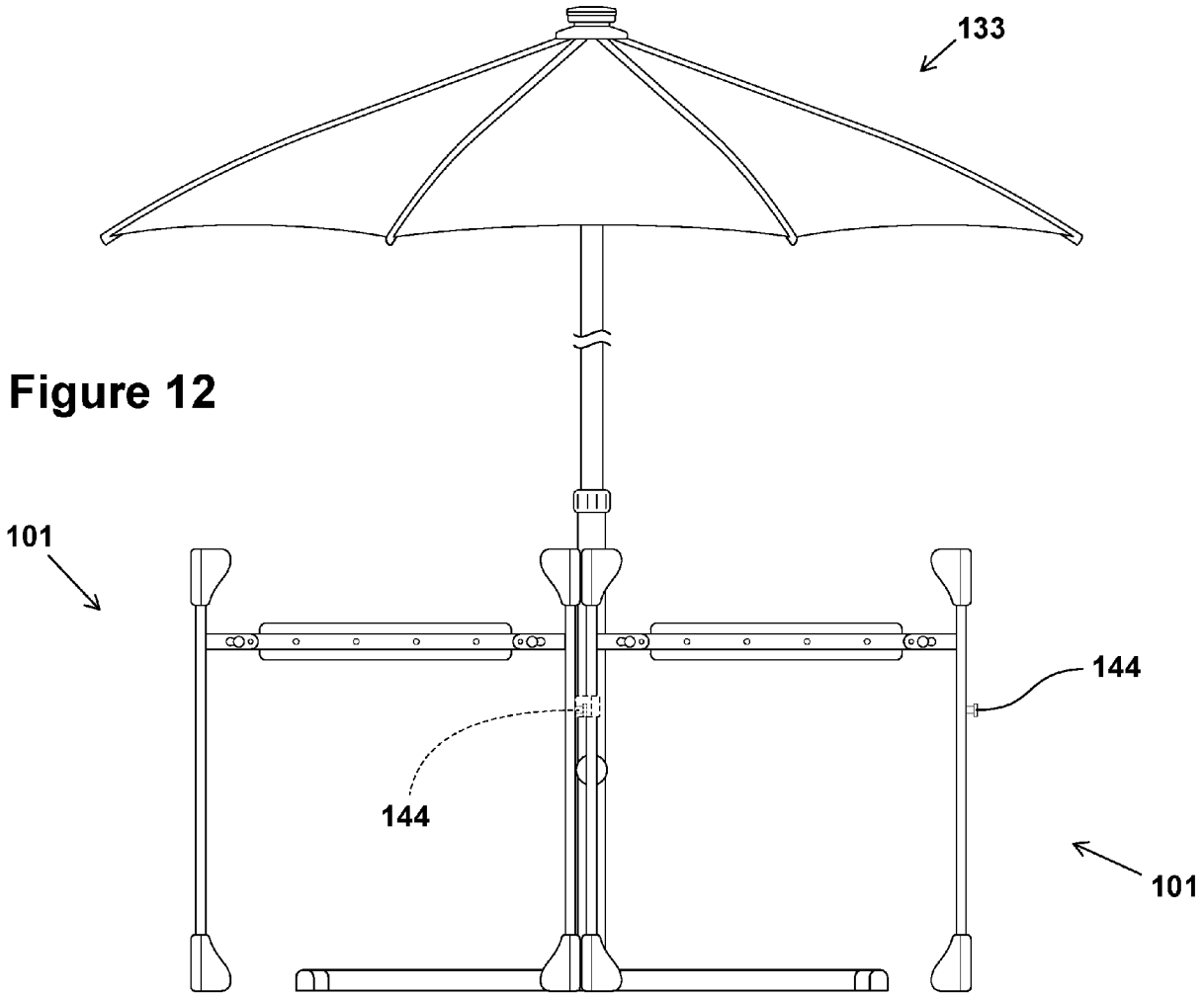
FIGS. 12, 13A, and 13B illustrate front views of variations of snapped-together dual benches, multiple benches, dual kneelers, and multiple kneelers of the unique portable and foldable five-device-in-one system.
Figure 13A:
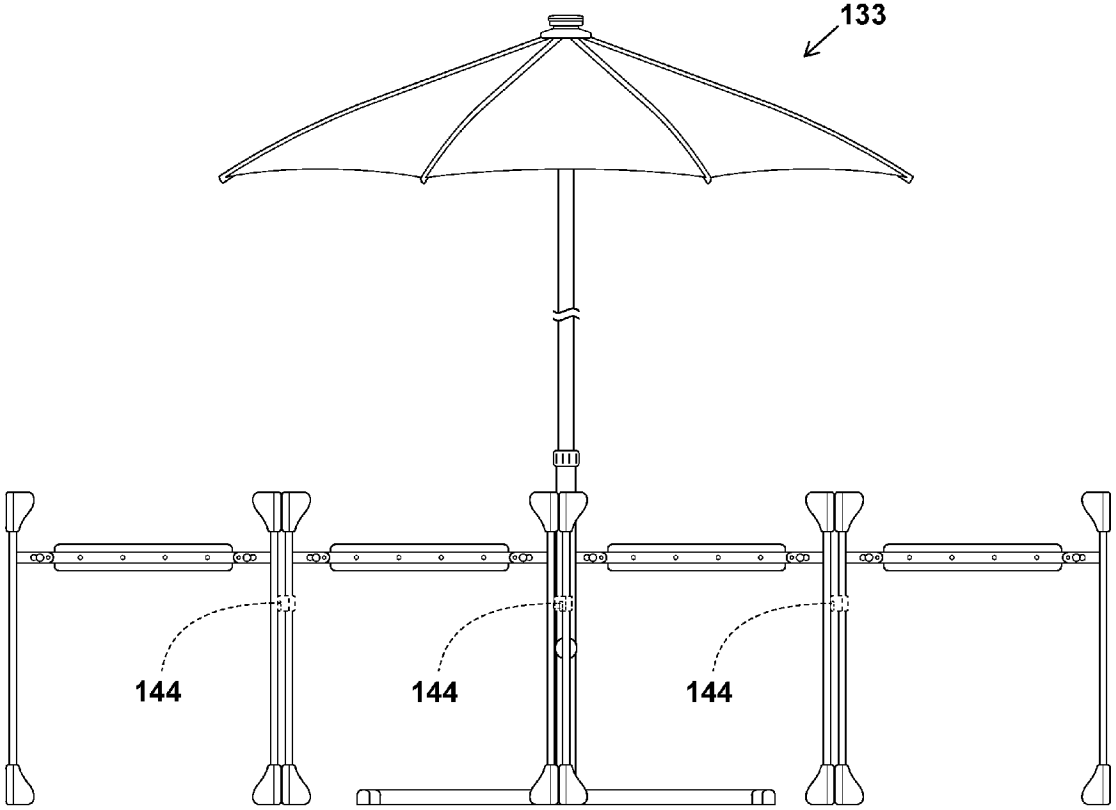
Figure 13B:
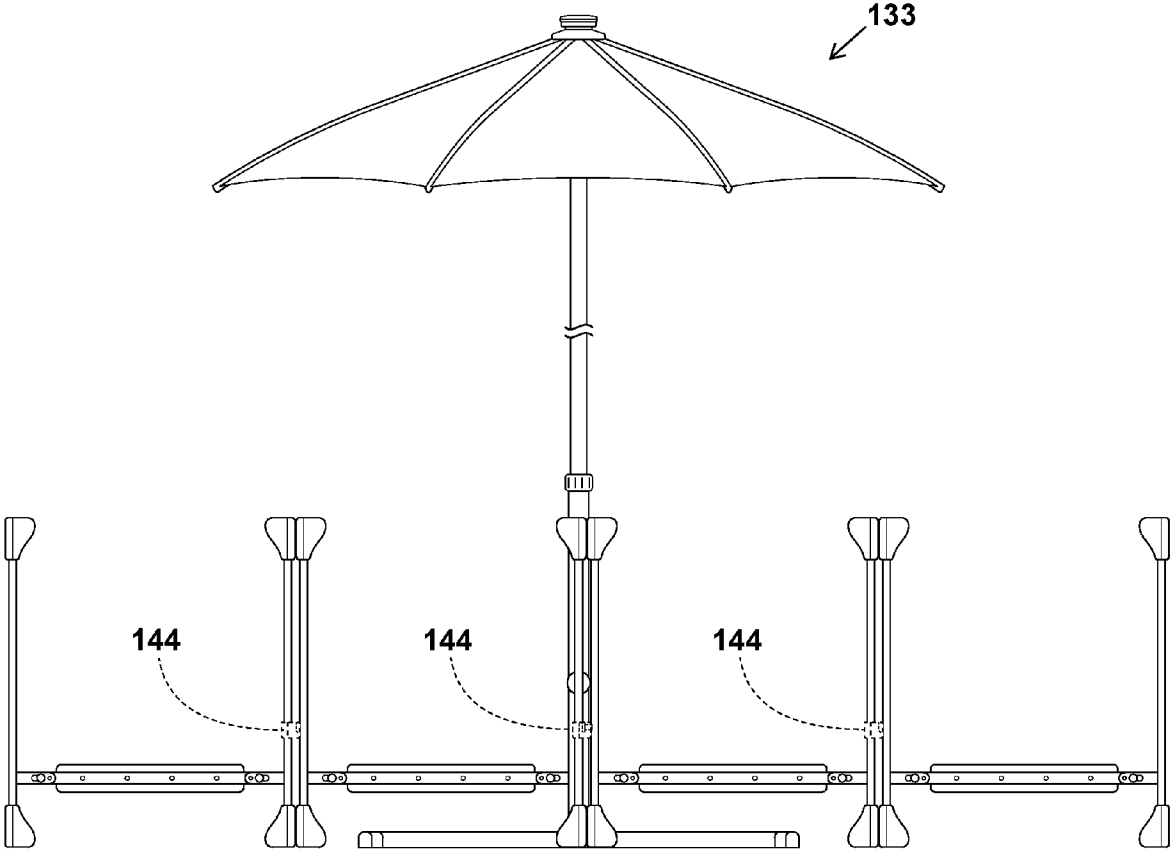

Referring to FIGS. 12, 13A, and 13B, further, the unique portable and foldable five-device-in-one system can comprise at least one additional system, which can be snapped on or hooked on dual-sitting dual-bench-attaching buttons 144 to provide dual benches, multiple benches, dual kneelers, and multiple kneelers.

Figure 14:
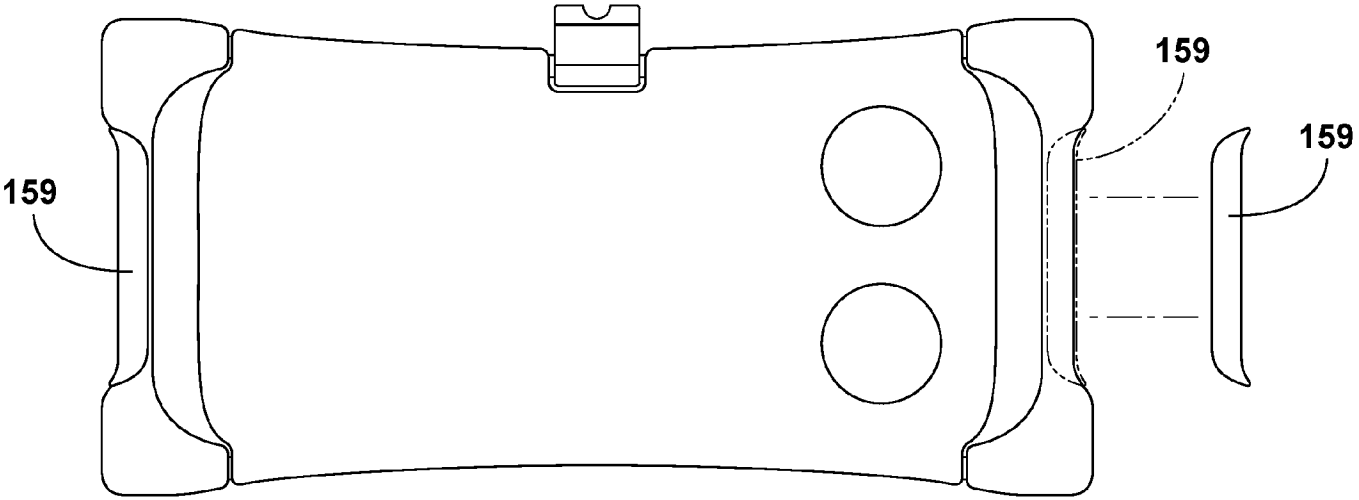
FIG. 14 illustrates a left view of a quadruple-function foot-handle-caddy-table system, with a rubber sleeve snapped on the dual-function foot-handle for added comfort.

Referring to FIG. 14, further, the unique portable and foldable five-device-in-one system can comprise at least one rubber handle sleeve 159, which can be snapped on first and second dual-function foot-handles 103, to provide additional comfort for people.

Major Unique Advantages of the Invention

The present invention substantially departs from the conventional concepts and designs of the prior art. In doing so, the present invention provides a unique portable and foldable five-device-in-one system of a garden kneeler, a garden bench, multiple garden caddies, multiple garden tables, and a garden umbrella, having many unique and significant features, functions, and advantages, which overcome all the disadvantages of the prior art, as follows:

1) It is an object of the present invention to provide a unique portable and foldable five-device-in-one kneeler-bench-caddy-table-umbrella system,
   having the following five-device-in-one portable and foldable devices:
   1) A portable and foldable kneeler to kneel on,
   2) A portable and foldable bench to sit and rest on, 3) Multiple portable and foldable caddies to store garden tools in,
4) Multiple portable and foldable tables to hold foods and refreshment, and
5) A portable and foldable umbrella.

The above-mentioned five-device-in-one portable and foldable devices:

a) Can be combined into one
to provide protection from the sun and rain to people while they are utilizing the kneeler, caddie, bench, or table;
b) Can be combined into one
to meet a wide variety of customer needs from gardening, to sitting in the shade, to storing tools, to keeping tools handy, to providing tables for foods and refreshments, without the need for purchasing additional devices;
c) Can be combined into one lightweight, portable, and foldable package to provide the extra convenience of having all parts and pieces connected into one user-friendly system;
d) Can be combined into one lightweight, portable, and foldable package to easily lift, carry, store, and throw in the car for use at any outing;
e) Save materials;
f) Save production costs;
g) Save labor, time, and money; and
h) Promote happy customers by passing savings down to consumers.

2) It is another object of the present invention to provide a unique portable and foldable five-device-in-one kneeler-bench-caddy-table-umbrella system,
having two quadruple-function foot-handle-caddy-table systems.

Therefore, the unique portable and foldable five-device-in-one kneeler-bench-caddy-table-umbrella system:

a) Can hold foods for people
to eat;
b) Can hold refreshment for people
to drink;
c) Are convenient and user-friendly;
d) Are easily operated; and
e) Are reliable.

3) It is a further object of the present invention to provide a unique portable and foldable five-device-in-one kneeler-bench-caddy-table-umbrella system,
having four dual-function foot-handles.

Therefore, the unique portable and foldable five-device-in-one kneeler-bench-caddy-table-umbrella system:

a) Can provide wide foot prints for stable contacts with the ground
to stabilize the unique portable and foldable five-device-in-one kneeler-bench-caddy-table-umbrella system;
b) Can provide wide handles for secure grips to easily hold onto
to pull oneself up from kneeling;
c) Are convenient and user-friendly;
d) Are easily operated; and
e) Are reliable.

4) It is an even further object of the present invention to provide a unique portable and foldable five-device-in-one kneeler-bench-caddy-table-umbrella system,
having four piston-stabilizing cylinders.

Therefore, the unique portable and foldable five-device-in-one kneeler-bench-caddy-table-umbrella system:

a) Can stabilize the oscillations of the four pistons of the unique portable and foldable five-device-in-one kneeler-bench-caddy-table-umbrella system in straight lines
to prevent the four pistons from bending and getting jammed;
b) Can align the oscillations of the four pistons of the unique portable and foldable five-device-in-one kneeler-bench-caddy-table-umbrella system in straight lines
to prevent the four pistons from bending and getting jammed;
c) Can stabilize the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
d) Can align the oscillations of the two finger-centralizing curved bars of the unique portable and foldable five-device-in-one kneeler-bench-caddy-table-umbrella system
in straight lines
to prevent the two finger-centralizing curved bars from bending and getting jammed;
e) Are easily operated;
f) Are reliable; and
g) Have a prolonged service lifespan.

5) It is another object of the present invention to provide a unique portable and foldable five-device-in-one kneeler-bench-caddy-table-umbrella system,
having two finger-centralizing curved bars.

Therefore, the unique portable and foldable five-device-in-one kneeler-bench-caddy-table-umbrella system:

a) Can centralize a person's fingers on the two finger-centralizing curved bars and away from the opposite ends of the two finger-centralizing curved bars
to prevent the fingers from accidentally being pinched by the opposite ends of the two finger-centralizing curved bars;
b) Prevent accidents from happening;
c) Prevent pain and personal injury; and
d) Prevent medical expenses.

6) It is still another object of the present invention to provide a unique portable and foldable five-device-in-one kneeler-bench-caddy-table-umbrella system,
having four finger-protecting shields.

Therefore, the unique portable and foldable five-device-in-one kneeler-bench-caddy-table-umbrella system:

a) Can shield a person's fingers from the opposite ends of the two finger-centralizing curved bars
to prevent the fingers from accidentally getting pinched by the opposite ends of the two finger-centralizing curved bars;
b) Prevent accidents from happening;
c) Prevent pain and personal injury; and
d) Prevent medical expenses.

7) It is a further object of the present invention to provide a unique portable and foldable five-device-in-one kneeler-bench-caddy-table-umbrella system,
having four teardrop-like U-frame openings.

Therefore, the unique portable and foldable five-device-in-one kneeler-bench-caddy-table-umbrella system:

a) Can centralize the opposite ends of the two finger-centralizing curved bars while they are oscillating between a locked and unlocked position to prevent the opposite ends of the two finger-centralizing curved bars from bending and getting jammed in the four teardrop-like U-frame openings;

b) Are easily operated;

c) Are reliable; and d) Have a prolonged service lifespan.

8) It is an even further object of the present invention to provide a unique portable and foldable five-device-in-one kneeler-bench-caddy-table-umbrella system, having two multi-purpose tables and multiple built-in cup holders.

Therefore, the unique portable and foldable five-device-in-one kneeler-bench-caddy-table-umbrella system:

a) Can serve as multiple outdoor shaded multi-purpose tables with multiple built-in cup holders to hold foods and refreshments for people to eat and drink in the shade while they are working, resting, or playing outdoors;

b) Can serve as multiple outdoor shaded cup holders to secure drinking glasses, drinking cups, or beverage cans therein against wind;

c) Provide convenience; and d) Provide multiple means to hold foods and refreshments securely.

9) It is yet a further object of the present invention to provide a unique portable and foldable five-device-in-one kneeler-bench-caddy-table-umbrella system, having two elastic garden-tool multi-pocket caddies.

Therefore, the unique portable and foldable five-device-in-one kneeler-bench-caddy-table-umbrella system:

a) Can tightly and separately carry multiple garden tools in separate pockets to keep tools organized, and to have them within convenient reach when kneeling on the portable and foldable kneeler of the unique portable and foldable five-device-in-one kneeler-bench-caddy-table-umbrella system to weed, plant, or do other yard work;

b) Can tightly and separately store multiple garden tools in separate pockets to keep tools organized, and to have them within convenient reach when kneeling on the portable and foldable kneeler of the unique portable and foldable five-device-in-one kneeler-bench-caddy-table-umbrella system to weed, plant, or do other yard work;

c) Help with keeping track of tools; and d) Help eliminate tripping hazards when tools are scattered on the ground.

10) It is yet an even further object of the present invention to provide a unique portable and foldable five-device-in-one kneeler-bench-caddy-table-umbrella system, having five-device-in-one compact and foldable devices of a garden kneeler, a garden bench, garden caddies, garden tables, and a garden umbrella combined into one.

Therefore, the unique portable and foldable five-device-in-one kneeler-bench-caddy-table-umbrella system:

a) Can be easily assembled and disassembled to provide easy set-up and take-down, without the need for tools;

b) Can be easily folded down into a compact size and packed into a carrying bag to allow easy transport and to make it easy to reach a desired location without forgetting any parts;

c) Can easily be transformed from a kneeler, to a bench, and to a table all with sunshade umbrella attached to meet people's needs for sitting, resting, eating, drinking, and gardening, at any time;

d) Are compact when folded, and saves space;

e) Are portable; and f) Are easily stored in a carrying bag.

11) It is still yet an even further object of the present invention to provide a unique portable and foldable five-device-in-one kneeler-bench-caddy-table-umbrella system, having kneeler-bench-caddy-table-locking arm and arm-locking button.

Therefore, the unique portable and foldable five-device-in-one kneeler-bench-caddy-table-umbrella system:

a) Can lock two multi-purpose tables and multiple built-in cup holders in an upright position to easily and conveniently hold foods and refreshments;

b) Can lock two tool-organizing caddies in a horizontal position to easily and conveniently store and keep garden tools organized;

c) Can lock a kneeler-bench cushion in a vertical position to provide a cushion for people to lean against while resting, eating, and drinking;

d) Are convenient and user-friendly;

e) Are easily operated; and f) Are reliable.

12) It is still yet an even further object of the present invention to provide a unique portable and foldable five-device-in-one kneeler-bench-caddy-table-umbrella system, having kneeler-bench-caddy-table-mounting clamp.

Therefore, the unique portable and foldable five-device-in-one kneeler-bench-caddy-table-umbrella system:

a) Can rotatably attach a foldable kneeler, a foldable bench, two foldable caddies, and two foldable tables to an adjustable foldable umbrella to easily and conveniently combine five devices into one;

b) Can rotatably allow the unique portable and foldable five-device-in-one kneeler-bench-caddy-table-umbrella system to easily and conveniently convert into a garden kneeler, two tool-organizing caddies, and an adjustable umbrella;

c) Can rotatably allow the unique portable and foldable five-device-in-one kneeler-bench-caddy-table-umbrella system to easily and conveniently convert into a garden bench, two tool-organizing caddies, and an adjustable umbrella;

d) Can rotatably allow the unique portable and foldable five-device-in-one kneeler-bench-caddy-table-umbrella system to easily and conveniently convert into two multi-purpose tables, two tool-organizing caddies, and an adjustable umbrella;

e) Can rotatably allow the unique portable and foldable five-device-in-one kneeler-bench-caddy-table-umbrella system to easily and conveniently convert into two tool-organizing caddies, an adjustable umbrella, and a garden kneeler, a garden bench, or two multi-purpose tables;

f) Are convenient and user-friendly;

g) Are easily operated;

h) Are reliable;

i) Save materials;

j) Save production costs;

k) Save labor, time, and money; and l) Promote happy customers by passing savings down to consumers.

What is claimed is:

1. A portable and foldable five-device-in-one system of a garden kneeler, a garden bench, garden caddies, garden tables, and a garden umbrella, comprising:

two quadruple-function foot-handle-caddy-table systems,
said two quadruple-function foot-handle-caddy-table systems comprising:
two multi-purpose tables having
four opposite table ends and two table undersurfaces respectively,
four dual-function foot-handles attached to
said four opposite table ends respectively, and
two elastic garden-tool multi-pocket caddies sewn to or otherwise attached to said two table undersurfaces respectively;

two dual-stabilizing finger-centralizing systems,
said two dual-stabilizing finger-centralizing systems comprising:
two U-frames welded to
said two multi-purpose tables and having
four opposite U-frame ends respectively,
four U-frame openings formed at
said four opposite U-frame ends respectively,
four piston-stabilizing cylinders welded to said two U-frames respectively, each of said two U-frames having two of said four pistons-stabilizing cylinders welded thereto,
four pistons inserted into said four piston-stabilizing cylinders respectively,
four springs slid on said four pistons respectively,
two finger-centralizing curved bars welded to
said four pistons and having
four opposite curved-bar ends respectively wherein
said four opposite curved-bar ends are inserted through
said four U-frame openings respectively, and
four finger-protecting shields welded generally close to
said four opposite curved-bar ends respectively;

a kneeler-bench-cushioning system,
said kneeler-bench-cushioning system comprising:
two cushion-supporting I-bars having
four opposite I-bar ends and
rotatably attached to and releasably locked to said two U-frames at
said four opposite I-bar ends respectively,
four curved-bar-locking recesses formed at
said four opposite I-bar ends respectively, and
kneeler-bench cushion attached to
said two cushion-supporting I-bars; and an adjustable foldable kneeler-bench-caddy-table umbrella,
said adjustable foldable kneeler-bench-caddy-table umbrella comprising:
a pole,
a canopy being foldable and slidably and lockably attached to said pole,
a base being detachably and rotatably attached to said pole,
said pole being telescopically adjustable and tiltable with respect to said base,
a plurality of foldable legs attached to said adjustable pole,
a kneeler-bench-caddy-table-mounting clamp attached to said adjustable pole,
a kneeler-bench-caddy-table-locking arm rotatably attached to said adjustable pole and having
an arm end,
a kneeler-bench-caddy-table-locking recess formed into
said arm end, and
an arm-locking button welded to one of said two multi-purpose tables, wherein
said two multi-purpose tables are for
holding foods and refreshment for people
to eat and drink,
said four dual-function foot-handles are for
providing wide feet for stable contacts with the ground
to stabilize the portable and foldable five-device-in-one system, and
providing wide handles for secure grips to easily hold onto
to pull oneself up from kneeling, and
said two elastic garden-tool multi-pocket caddies are for
carrying garden tools and implements
to conveniently keep garden tools and
implements organized where people work, and
storing garden tools and implements
to handily provide garden tools and
implements where people work, wherein
said four U-frame openings are for
locking said four opposite curved-bar ends therein
to lock said two quadruple-function foot-handle-caddy-table systems to said kneeler-bench-cushioning system, and
centralizing said four opposite curved-bar ends therein
to prevent said four opposite curved-bar ends from getting jammed,
said four pistons having piston oscillations respectively,
said four piston-stabilizing cylinders are for
stabilizing said piston oscillations of said four pistons respectively
to prevent said four opposite curved-bar ends from getting jammed, and
aligning said piston oscillations of said four pistons respectively
to prevent said four opposite curved-bar ends from getting jammed,
said two finger-centralizing curved bars having bar oscillations respectively,
said four pistons are for
stabilizing said bar oscillations of said two finger-centralizing curved bars respectively
to prevent said four opposite curved-bar ends from getting jammed, and
aligning said bar oscillations of said two finger-centralizing curved bars respectively
to prevent said four opposite curved-bar ends from getting jammed,
said two finger-centralizing curved bars are for
centralizing fingers when said fingers are applied thereon
to prevent said fingers from getting pinched,
said four finger-protecting shields are for
stabilizing said bar oscillations of said two finger-centralizing curved bars respectively to prevent said four opposite curved-bar ends from getting jammed, aligning said bar oscillations of said two finger-centralizing curved bars respectively to prevent said four opposite curved-bar ends from getting jammed, and shielding said fingers from said four U-frame openings to prevent said fingers from getting pinched, wherein said two cushion-supporting I-bars are for supporting said kneeler-bench cushion, said four curved-bar-locking recesses are for locking said four opposite curved-bar ends therein respectively, said kneeler-bench cushion is for being rotated to convert to a garden-kneeler cushion for people to kneel on to work, being rotated to convert to a garden-bench cushion for people to sit on to rest, eat, and drink, and being rotated to convert to a table-supporting cushion for people to lean against to rest, eat, and drink, wherein said foldable canopy is for providing shading protection, said kneeler-bench-caddy-table-mounting clamp is for rotatably attaching said two quadruple-function foot-handle-caddy-table systems to said adjustable foldable kneeler-bench-caddy-table umbrella to easily convert the portable and foldable five-device-in-one system to provide a garden kneeler, rotatably attaching said two quadruple-function foot-handle-caddy-table systems to said adjustable foldable kneeler-bench-caddy-table umbrella to easily convert the portable and foldable five-device-in-one system to provide a garden bench, rotatably attaching said two quadruple-function foot-handle-caddy-table systems to said adjustable foldable kneeler-bench-caddy-table umbrella to easily convert the portable and foldable five-device-in-one system to provide two tables, and releasably attaching said two quadruple-function foot-handle-caddy-table systems to said adjustable foldable kneeler-bench-caddy-table umbrella to easily assemble, disassemble, transport, and store the portable and foldable five-device-in-one system, said kneeler-bench-caddy-table-locking arm is for releasably locking said two multi-purpose tables in an upright position to hold foods and refreshment for people to eat and drink, said arm-locking button is for releasably snap-locking in said kneeler-bench-caddy-table-locking recess to releasably lock said two multi-purpose tables in an upright position to hold foods and refreshment for people to eat and drink, whereby the portable and foldable five-device-in-one system of a garden kneeler, a garden bench, garden caddies, garden tables, and a garden umbrella:

can be converted to a garden table for holding foods and refreshment for people to eat and drink, can be converted to a garden kneeler for people to kneel on and work, can be converted to a garden bench for people to sit on to rest, eat, and drink, can be converted to a table-supporting cushion for people to lean against to rest, eat, and drink, can provide garden caddies for carrying garden tools and implements to conveniently organize garden tools and implements where people work, can provide garden caddies for storing garden tools and implements to handily provide garden tools and implements where people work, can provide wide handles for secure grips to pull oneself up from kneeling, can provide wide feet for stabilizing the portable and foldable five-device-in-one system on the ground, can prevent said four opposite curved-bar ends from getting jammed, can prevent said fingers from getting pinched, and can be quickly and easily assembled and disassembled for easy and convenient transport and storage.

2. The portable and foldable five-device-in-one system of claim 1, wherein said two multi-purpose tables comprise two table tops, two O frames for supporting said two table tops, and a plurality of table-top clamps molded to said two table tops for snap-locking on said two O frames to attach said two table tops to said two O frames, respectively.

3. The portable and foldable five-device-in-one system of claim 1, further, comprising a plurality of rubber sleeves for providing grips and comfort, said rubber sleeves snap-locked on or otherwise attached to said four dual-function foot-handles, respectively.

4. The portable and foldable five-device-in-one system of claim 1, further, comprising at least one attaching button, at least one additional two quadruple-function foot-handle-caddy-table systems, at least one additional two dual-stabilizing finger-centralizing systems, and at least one additional kneeler-bench-cushioning system attached together respectively, for providing multiple kneelers and benches.

5. The portable and foldable five-device-in-one system of claim 1, wherein said two multi-purpose tables have at least one through-hole for holding at least one drinking cup or glass therein.

6. The portable and foldable five-device-in-one system of claim 1, wherein said foldable legs comprise at least three legs.

7. The portable and foldable five-device-in-one system of claim 1, wherein at least one component of the portable and foldable five-device-in-one system is made of a material selected from the group consisting of: fiber glass, canvas, fabric, metal, rubber, and plastic.

8. The portable and foldable five-device-in-one system of claim 1, further, comprising a five-device-in-one-system-carrying bag for storing and carrying the portable and foldable five-device-in-one system.

9. The portable and foldable five-device-in-one system of claim 8, further, comprising a zipper, wherein said five-device-in-one-system-carrying bag having a bag opening and bag-opening edge encompassing said bag opening, said zipper sewn to and along said bag-opening edge, said zipper for closing and opening said bag opening.

10. A portable and foldable five-device-in-one system comprising:

two foot-handle-caddy-table systems,
said two foot-handle-caddy-table systems comprising:
two multi-purpose tables having
four opposite table ends and two table undersurfaces respectively,
four foot-handles attached to
said four opposite table ends respectively, and
two multi-pocket caddies sewn to or otherwise attached to
said two table undersurfaces respectively;

two finger-centralizing systems,
said two finger-centralizing systems comprising:
two U-frames welded to
said two multi-purpose tables and having
four opposite U-frame ends respectively,
four U-frame openings formed at
said four opposite U-frame ends respectively,
four piston-stabilizing cylinders welded to said two U-frames respectively, each of said two U-frames having two of said four pistons-stabilizing cylinders welded thereto,
four pistons inserted into said four piston-stabilizing cylinders respectively,
four springs slid on said four pistons respectively,
two finger-centralizing curved bars welded to
said four pistons and having
four opposite curved-bar ends respectively wherein
said four opposite curved-bar ends are inserted through
said four U-frame openings respectively, and
four finger-protecting shields welded generally close to
said four opposite curved-bar ends respectively;

a cushioning system,
said cushioning system comprising:
two cushion-supporting I-bars having
four opposite I-bar ends and
rotatably attached to and releasably locked to said two U-frames at
said four opposite I-bar ends respectively,
four curved-bar-locking recesses formed at
said four opposite I-bar ends respectively, and
a cushion attached to
said two cushion-supporting I-bars; and an adjustable foldable umbrella,
said adjustable foldable umbrella comprising:
a pole,
a canopy being foldable and slidably and lockably attached to said pole,
a base being detachably and rotatably attached to said pole,
said pole being telescopically adjustable and tiltable with respect to said base,
a plurality of foldable legs attached to said adjustable pole,
a mounting clamp attached to said adjustable pole,
a table-locking arm rotatably attached to said adjustable pole and having
an arm end,
a table-locking recess formed into
said arm end, and
an arm-locking button welded to one of said two multi-purpose tables, wherein
said two multi-purpose tables are for
holding foods and refreshment for people
to eat and drink,
said four foot-handles are for
providing wide feet for stable contacts with the ground
to stabilize the portable and foldable five-device-in-one system, and
providing wide handles for secure grips to easily hold onto
to pull oneself up from kneeling, and
said two multi-pocket caddies are for
carrying garden tools and implements
to conveniently keep garden tools and implements organized where people work, and
storing garden tools and implements
to handily provide garden tools and implements where people work, wherein
said four U-frame openings are for
locking said four opposite curved-bar ends therein
to lock said two foot-handle-caddy-table systems to said cushioning system, and
centralizing said four opposite curved-bar ends therein
to prevent said four opposite curved-bar ends from getting jammed,
said four pistons having piston oscillations respectively,
said four piston-stabilizing cylinders are for
stabilizing said piston oscillations of said four pistons respectively
to prevent said four opposite curved-bar ends from getting jammed, and
aligning said piston oscillations of said four pistons respectively
to prevent said four opposite curved-bar ends from getting jammed,
said two finger-centralizing curved bars having bar oscillations respectively,
said four pistons are for
stabilizing said bar oscillations of said two finger-centralizing curved bars respectively
to prevent said four opposite curved-bar ends from getting jammed, and
aligning said bar oscillations of said two finger-centralizing curved bars respectively
to prevent said four opposite curved-bar ends from getting jammed,
said two finger-centralizing curved bars are for
centralizing fingers when said fingers are applied thereon
to prevent said fingers from getting pinched,
said four finger-protecting shields are for
stabilizing said bar oscillations of said two finger-centralizing curved bars respectively
to prevent said four opposite curved-bar ends from getting jammed,
aligning said bar oscillations of said two finger-centralizing curved bars respectively
to prevent said four opposite curved-bar ends from getting jammed, and
shielding said fingers from said four U-frame openings
to prevent said fingers from getting pinched, wherein
said two cushion-supporting I-bars are for
supporting said cushion,
said four curved-bar-locking recesses are for
locking said four opposite curved-bar ends therein respectively,
said cushion is for
being rotated to convert to a garden-kneeler cushion for people
to kneel on to work,
being rotated to convert to a garden-bench cushion for people
to sit on to rest, eat, and drink, and
being rotated to convert to a table-supporting cushion for people
to lean against to rest, eat, and drink,
wherein
said foldable canopy is for
providing shading protection,
said mounting clamp is for
rotatably attaching said two foot-handle-caddy-table systems to said adjustable foldable umbrella
to easily convert the portable and foldable five-device-in-one system to provide a garden kneeler,
rotatably attaching said two foot-handle-caddy-table systems to said adjustable foldable umbrella
to easily convert the portable and foldable five-device-in-one system to provide a garden bench,
rotatably attaching said two foot-handle-caddy-table systems to said adjustable foldable umbrella
to easily convert the portable and foldable five-device-in-one system to provide two tables, and
releasably attaching said two foot-handle-caddy-table systems to said adjustable foldable umbrella
to easily assemble, disassemble, transport, and store the portable and foldable five-device-in-one system,
said table-locking arm is for
releasably locking said two multi-purpose tables in an upright position to hold foods and refreshment for people to eat and drink,
said arm-locking button is for
releasably snap-locking in said table-locking recess
to releasably lock said two multi-purpose tables in an upright position to hold foods and refreshment for people to eat and drink,
whereby
the portable and foldable five-device-in-one system:
can be converted to a garden table
for holding foods and refreshment for people to eat and drink,
can be converted to a garden kneeler
for people to kneel on and work,
can be converted to a garden bench
for people to sit on to rest, eat, and drink,
can be converted to a table-supporting cushion
for people to lean against to rest, eat, and drink,
can provide garden caddies
for carrying garden tools and implements
to conveniently organize garden tools and implements where people work,
can provide garden caddies
for storing garden tools and implements
to handily provide garden tools and implements where people work,
can provide wide handles
for secure grips to pull oneself up from kneeling,
can provide wide feet
for stabilizing the portable and foldable five-device-in-one system on the ground,
can prevent said four opposite curved-bar ends
from getting jammed,
can prevent said fingers
from getting pinched, and
can be quickly and easily assembled and disassembled
for easy and convenient transport and storage.

11. The portable and foldable five-device-in-one system of claim 10, wherein said two multi-purpose tables comprise two table tops, two O frames for supporting said two table tops, and a plurality of table-top clamps molded to said two table tops for snap-locking on said two O frames to attach said two table tops to said two O frames, respectively.

12. The portable and foldable five-device-in-one system of claim 10, further, comprising a plurality of rubber sleeves for providing grips and comfort, said rubber sleeves snap-locked on or otherwise attached to said four foot-handles, respectively.

13. The portable and foldable five-device-in-one system of claim 10, further, comprising at least one attaching button,
at least one additional two foot-handle-caddy-table systems,
at least one additional two forger-centralizing systems, and
at least one additional cushioning system
attached together respectively, for providing multiple kneelers and benches.

14. The portable and foldable five-device-in-one system of claim 10, wherein said two multi-purpose tables have at least one through-hole for holding at least one drinking cup or glass therein.

15. The portable and foldable five-device-in-one system of claim 10, wherein at least one component of the portable and foldable five-device-in-one system is made of a material selected from the group consisting of: fiber glass, canvas, fabric, metal, rubber, and plastic.

16. A kneeler system comprising:
two foot-handle-caddy-table systems,
said two foot-handle-caddy-table systems comprising:
two tables having
four opposite table ends and two table undersurfaces respectively,
four foot-handles attached to
said four opposite table ends respectively, and
a plurality of caddies sewn to or otherwise attached to said two table undersurfaces respectively;
two finger-centralizing systems,
said two finger-centralizing systems comprising:
two U-frames welded to
said two tables and having
four opposite U-frame ends respectively,
four U-frame openings formed at
said four opposite U-frame ends
respectively,
four piston-stabilizing cylinders welded to said two U-frames respectively, each of said two U-frames having two of said four pistons-stabilizing cylinders welded thereto,
four pistons inserted into said four piston-stabilizing cylinders respectively,
four springs slid on said four pistons respectively,
two curved bars welded to
said four pistons and having
four opposite curved-bar ends respectively wherein
said four opposite curved-bar ends are inserted through
said four U-frame openings respectively, and four finger-protecting shields welded generally close to said four opposite curved-bar ends respectively;

a cushioning system, said cushioning system comprising:

two cushion-supporting I-bars having four opposite I-bar ends and rotatably attached to and releasably locked to said two U-frames at said four opposite I-bar ends respectively, four curved-bar-locking recesses formed at said four opposite I-bar ends respectively, and a cushion attached to said two cushion-supporting I-bars; and an umbrella, said umbrella comprising:

a pole, a canopy being foldable and slidably and lockably attached to said pole, a base being detachably and rotatably attached to said pole, said pole being telescopically adjustable and tiltable with respect to said base, a plurality of foldable legs attached to said adjustable pole, a mounting clamp attached to said adjustable pole, a table-locking arm rotatably attached to said adjustable pole and having an arm end, a table-locking recess formed into said arm end, and an arm-locking button welded to one of said two tables, wherein said two tables are for holding foods and refreshment, said four foot-handles are for providing wide feet for stable contacts with the ground, and providing wide handles for secure grips to easily hold onto, and said caddies are for carrying garden tools and implements, and storing garden tools and implements, wherein said four U-frame openings are for locking said four opposite curved-bar ends therein, and centralizing said four opposite curved-bar ends therein, said four pistons having piston oscillations respectively, said four piston-stabilizing cylinders are for stabilizing said piston oscillations of said four pistons respectively, and aligning said piston oscillations of said four pistons respectively, said two curved bars having bar oscillations respectively, said four pistons are for stabilizing said bar oscillations of said two curved bars respectively, and aligning said bar oscillations of said two curved bars respectively, said two curved bars are for centralizing fingers when said fingers are applied thereon, said four finger-protecting shields are for stabilizing said bar oscillations of said two curved bars respectively, aligning said bar oscillations of said two curved bars respectively, and shielding said fingers from said four U-frame openings, wherein said two cushion-supporting I-bars are for supporting said cushion, said four curved-bar-locking recesses are for locking said four opposite curved-bar ends therein respectively, said cushion is for being rotated to convert to a garden-kneeler cushion, being rotated to convert to a garden-bench cushion, and being rotated to convert to a table-supporting cushion, wherein said foldable canopy is for providing shading protection, said mounting clamp is for rotatably attaching said two foot-handle-caddy-table systems to said umbrella to provide a garden kneeler, a garden bench, and two tables, and releasably attaching said two foot-handle-caddy-table systems to said umbrella to easily assemble, disassemble, transport, and store the kneeler system, said table-locking arm is for releasably locking said two tables in an upright position, said arm-locking button is for releasably snap-locking in said table-locking recess to releasably lock said two tables in an upright position.

17. The kneeler system of claim 16, wherein said two tables comprise two table tops, two O frames for supporting said two table tops, and a plurality of table-top clamps molded to said two table tops for snap-locking on said two O frames to attach said two table tops to said two O frames, respectively.

18. The kneeler system of claim 16, further, comprising a plurality of rubber sleeves for providing grips and comfort, said rubber sleeves snap-locked on or otherwise attached to said four foot-handles, respectively.

19. The kneeler system of claim 16, further, comprising at least one attaching button, at least one additional two foot-handle-caddy-table systems, at least one additional two finger-centralizing systems, and at least one additional cushioning system attached together respectively, for providing multiple kneelers and benches.

20. The kneeler system of claim 16, wherein at least one component of the kneeler system is made of a material selected from the group consisting of: fiber glass, canvas, fabric, metal, rubber, and plastic.

* * * * *